US006599106B2

(12) United States Patent
Harada et al.

(10) Patent No.: US 6,599,106 B2
(45) Date of Patent: Jul. 29, 2003

(54) TUBE PUMP AND INK JET RECORDING APPARATUS INCORPORATING THE SAME

(75) Inventors: Shuhei Harada, Nagano (JP); Atsushi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 120 days.

(21) Appl. No.: 09/783,125

(22) Filed: Feb. 15, 2001

(65) Prior Publication Data

US 2001/0019344 A1 Sep. 6, 2001

(30) Foreign Application Priority Data

| | | |
|---|---|---|
| Feb. 15, 2000 | (JP) | 2000-036734 |
| May 22, 2000 | (JP) | 2000-149712 |
| Nov. 20, 2000 | (JP) | 2000-352478 |
| Jan. 19, 2001 | (JP) | 2001-011437 |

(51) Int. Cl.[7] ..... F04B 43/00; F04B 43/08

(52) U.S. Cl. ..... 417/412; 417/474; 417/477.3; 417/477.5; 417/477.7

(58) Field of Search ..... 417/412, 474, 417/477.3, 477.5, 477.7; 347/85, 30

(56) References Cited

U.S. PATENT DOCUMENTS

| | | | | |
|---|---|---|---|---|
| 2,917,002 A | * | 12/1959 | Mascaro | 417/477.5 |
| 4,315,718 A | * | 2/1982 | Hogan | 417/447.3 |
| 5,458,469 A | * | 10/1995 | Hauser | 417/474 |
| 6,264,438 B1 | * | 7/2001 | Fukami | 417/412 |
| 6,296,460 B1 | * | 10/2001 | Smith | 41/475 |

* cited by examiner

*Primary Examiner*—Charles G. Freay
*Assistant Examiner*—Michael K. Gray
(74) *Attorney, Agent, or Firm*—Sughrue Mion, PLLC

(57) ABSTRACT

In a tube pump, a rotor is fixed to a drive shaft so as to rotate therewith. A tube pressing member is swingable in an axial direction of the drive shaft. A swinging member swings the tube pressing member in accordance with the rotation of the rotor. An upper outer face of a tube is fixed to a lower portion of the tube pressing member. A lower outer face of the tube is fixed to a fixing member. The tube is forcibly pressed and expanded in accordance with the swing motion of the tube pressing member, while the pressed/expanded part is shifted in an extending direction.

39 Claims, 20 Drawing Sheets

TUBE PUMP AND INK JET RECORDING APPARATUS INCORPORATING THE SAME

BACKGROUND OF THE INVENTION

The present invention generally relates to a tube pump for generating a pressure by pressing and deforming a tube. More particularly, the invention relates to an ink jet recording apparatus using the tube pump, which is capable of restoring an ink ejection capability of the print head by discharging ink from the print head by utilizing a negative pressure generated by the tube pump. Further, the invention relates to an ink jet recording apparatus which is provided with the tube pump as an ink supplier for supplying ink from a main tank (ink pack) to a sub-tank.

The ink jet recording apparatus is advantageous in that noise generated during the printing operation is low, and small print dots may be arrayed at high density. Because of those advantages, the ink jet recording apparatus has used for a variety of printings, mainly for color printing, recently. The ink jet recording apparatus is provided with an ink jet recording head which receives ink from an ink cartridge, and a paper feeder for moving a recording sheet relatively to the recording head. To print, the ink jet recording apparatus, while moving the recording head, causes the recording head to eject ink drops onto the recording sheet and forms ink dots thereon, in accordance with a print signal.

Thus, the ink jet recording apparatus must unavoidably handle with liquid ink. Accordingly, to prevent the clogging of the nozzle orifices, which is caused by filling of ink to the recording head and volatilization of ink solvent, a process to restore the ink-ejection capability of the recording head is carried out in which ink is forcibly sucked and discharged from the recording head. The forcible discharging of ink, which is performed for removing the nozzle clogging or when air bubbles are left in the recording head, is called a cleaning operation. The cleaning operation is carried out when the recording apparatus, which is not in use for a long time, is operated again, and when the user finds out poor print, such as blur of printed characters, and operates a cleaning switch.

In the cleaning operation, the following sequence of steps is carried out. The recording head is sealingly capped with a capping member, and a negative pressure is applied to the capped head to forcibly discharge ink, by sucking, into the capping member through the nozzle orifices of the recording head. The ink discharged into the capping member is sucked and sent to a used ink tank by the utilization of a negative pressure. Thereafter, the nozzle plate of the recording head is wiped out by a cleaning member formed with an elastic material, e.g., rubber.

A called tube pump has been used for the means for applying a negative pressure into the capping member since it is relatively simple in structure and easy to be reduced in size, and further does not soil the mechanism for sucking and discharging ink. The tube pump will be described in detail with reference to FIG. 31.

The tube pump 74 includes a pump frame 72, a pump wheel 70, and a pair of rollers 71*a* and 71*b*. The pump frame 72 has a tube support surface 76 arcuately defining a configuration of a flexible tube 75. The pump wheel 70 is rotated by a motive power transmitted from a drive member such as a sheet-feeding motor. A couple of roller support grooves 70*a* and 70*b* are disposed while being radially slanted between an axial direction and a circumferential direction of the pump wheel 70. The rollers 71*a* and 71*b* are rotatably mounted so that those are movable within and along the roller support grooves 70*a* and 70*b*, respectively.

A pair of guide members 73*a* and 73*b*, made of an elastic material, are disposed at positions facing the pump wheel 70 formed on the pump frame 72, while extending in the axial direction of the pump wheel 70.

L-shaped engaging grooves 72*a* and 72*b* are formed in the pump frame 72. The guide members 73*a* and 73*b* are planted in those engaging grooves 72*a* and 72*b*, respectively.

With such a structure, the guide members 73*a* and 73*b* guide respectively the rollers along the roller support grooves in the rotation backward direction, with rotation of the pump wheel. When the cylindrical body 42 is rotated in the forward direction (direction A), the rollers 71*a* and 71*b* are pushed back by the guide members 73*a* and 73*b* made of the elastic material, respectively. As a result, the rollers 71*a* and 71*b*, respectively, move in the outer circumference direction of the roller support grooves 70*a* and 70*b*, and the flexible tube 75 is compressed flat. Accordingly, a reliability of the pump driving operation is improved.

In the tube pump thus constructed, when the pump wheel 70 is rotated in the forward direction (direction A of an arrow), as shown in FIG. 31, the rollers 71*a* and 71*b* move in the outer circumference direction of the roller support grooves 70*a* and 70*b*. Those rollers rotate while pressing the flexible tube 75 flat. As a result, a pressure is generated in the tube and a negative pressure is applied to the capping member. Under the negative pressure, ink is forcibly discharged from the recording head, and the ink discharged into the capping member is sucked and sent to the used ink tank.

Conversely, when the pump wheel 70 is rotated in the reverse direction (direction B of an arrow), the rollers 71*a* and 71*b* move in the inner circumference direction of the roller support grooves 70*a* and 70*b*. As a result, the rollers are put in a release state in which the rollers are in slight contact with the tube. Accordingly, a trouble, e.g., clinging of the tube, is avoided.

The tube pump is used for restoring the ink-ejection capability to cause the recording head to discharge ink therefrom, and also for supplying ink from a main tank, which stores ink therein, to a sub-tank provided in the recording head.

The ink jet recording apparatus, which is used for office or business use, needs an ink cartridge of a large capacity since it handles a relatively large amount of printing. For this reason, a main tank as an ink cartridge (ink pack) is set to a cartridge holder, which is located on the side of the body of the recording apparatus.

The sub-tank is placed on the carriage on which the recording head is mounted. Ink is supplied from the main tank to the sub-tank via an ink supplying tube. Further, ink is supplied from the sub-tank to the recording head.

In this type of the ink jet recording apparatus, the tube pump is used as the ink supplier for supplying ink from the main tank to the sub-tank.

As described above, in the related tube pump, the roller rotates while successively pressing the tube flat. Through the operation, a pressure is generated within the tube to give rise to a negative pressure.

Accordingly, the tube being pressed flat by the rotating roller is restored to its original shape by an elasticity of the flexible tube per se (self-restoring ability).

The thickness (difference between the inner and outer diameters of the tube) of the flexible tube must be secured in a certain level. If the flexible tube is extremely thin, the restoring force is unsatisfactory, and a required suction force cannot be produced.

If the flexible tube is thick, the inner diameter of the tube is small, so that a predetermined quantity of suction cannot be secured. If the inner diameter of the flexible tube is set at a fixed value, the outer diameter is also large, and consequently the whole tube pump is large in size, and hence the ink jet recording apparatus itself is large in size.

Additionally, in the related tube pump, the tube pressed flat restores to its initial state by the elasticity (self-restoring ability) of the tube itself. In this respect, the material which may be used for the tube must be selected from among limited kinds of materials. The metal tube made of aluminum or the like has less elasticity, and hence cannot be used for the tube of the related tube pump.

The elasticity (self-restoring ability) of the tube per se serves as a reaction force when the tube is pressed flat. This results in increase of the pressing load, so that the pump efficiency is impaired.

Furthermore, extreme care must be exercised on the clinging of the tube since the tube being pressed flat is restored to its original state by the elasticity of the flexible tube per se (self-restoring ability).

SUMMARY OF THE INVENTION

For the background reasons mentioned above, the present invention has an object to provide a tube pump which is different in basic construction from the related tube pump, allows the use of a tube not having the self-restoring ability, and is small in size and high in pump efficiency. The invention has another object to provide an ink jet recording apparatus constructed using such a tube pump.

In order to achieve the above object, according to the present invention, there is provided a tube pump, comprising:

- a drive shaft;
- a rotor, fixed to the drive shaft so as to rotate therewith;
- a tube pressing member, being swingable in an axial direction of the drive shaft;
- a swinging member for swinging the tube pressing member in accordance with the rotation of the rotor;
- a tube, an upper outer face of which is fixed to a lower portion of the tube pressing member;
- a fixing member, to which a lower outer face of the tube is fixed,
- wherein the tube is forcibly pressed and expanded in accordance with the swing motion of the tube pressing member, while the pressed/expanded part is shifted in an extending direction.

In this configuration, the tube is gradually pressed flat through a swing motion of the tube pressing member, and is returned to its original state. Accordingly, a tube having a small self-restoring ability or a low stiffness may be used for the tube. A thin tube may also be used. As a result, the size reduction of the tube pump is realized.

When the tube used is small in self-restoring ability or low in stiffness, a pressing load to the tube is lessened. Therefore, a tube pump of high pump efficiency is presented.

The term "fix" means a case where the tube is fastened to the tube pressing member, the tube fixing plate or the like by means of adhesion, and further welding, and further a case where the tube pressing plate or the like is formed integral with at least a part of the tube.

Preferably, the tube pressing member is provided as a plate member which is opposed to the rotor.

Preferably, the tube pump further comprises a spring member, for urging the fixing member toward the tube pressing member.

In this arrangement, the tube is pressed against the tube pressing member by the spring member. Therefore, when the rotor is made of a material having no elasticity, the tube is pressed flat at a fixed pressing force by the tube pressing member.

Here, it is preferable that the tube pump further comprises: a flange, formed at a lower end portion of the drive shaft, to which a lower end of the spring member is fixed; a plate member, to which an upper end of the spring member is fixed; and a ball bearing, provided between a lower face of the fixing member and an upper face of the plate member.

Preferably, the rotor is provided as a rotary disk member.

Here, it is preferable that the swinging member is provided as a ball body interposed between the rotary disk member and the tube pressing plate, so as to be movably fitted with a groove formed on an upper face of the tube pressing plate.

In this arrangement, a stable swinging motion of the tube pressing plate is secured.

Here, it is preferable that the groove is situated closer to the drive shaft than a cross sectional center of the tube.

In this arrangement, the pressing force of the tube pressing plate applied to the tube for pressing it flat is uniformly exerted on the tube, so that the tube is uniformly pressed to be closed. Therefore, there is no case where the tube is excessively pressed. The tube may be closed by a less amount of pressing and a less pressing load. This leads to reduction of the required drive torque of the pump, and hence presents a tube pump with high pump efficiency.

The lessening of the slanting of the tube pressing plate leads to the size reduction of the tube pump.

Here, it is preferable that the swinging member includes: a spring member, one end of which is fixed to the rotary disk member; a ball body, being movable on an upper face of the tube pressing plate; and a holder, to which the other end of the spring member is fixed, the holder for holding the ball body.

In this arrangement, the ball body is pressed against the tube pressing plate with the aid of the spring member. Accordingly, the tube pressing plate is swung at a fixed pressing force.

Alternatively, the rotor is provided as a rotary conical member.

Here, it is preferable that the swinging member is provided as a frustum body held by a side face of the rotary conical member, such that an axis of the frustum body is in parallel with a generatrix of the conical member.

Alternatively, the rotor is provided as a bar member, one end of which is fixed to the drive shaft.

Here, it is preferable that the swinging member is provided as a columnar body held by the bar member so as to be rotatable about an axis of the bar member.

Preferably, a through hole is formed at a center portion of the tube pressing plate, through which the drive shaft is inserted. The diameter of the through hole is larger than the diameter of the drive shaft. A cylindrical member is formed on a lower face of the tube pressing plate so as to surround the through hole.

In this arrangement, the tube pressing plate stably swings. When the swing of the tube pressing plate is large, the drive shaft sometimes comes in contact with the inner wall of the through hole of the tube pressing plate. In this case, the contact of the drive shaft with the tube pressing plate reduces the pump efficiency. Such a situation should be avoided as possible.

Preferably, the tube pressing plate is shaped into a hollowed cone so as to be swingable about a vertex of the cone.

In this arrangement, the tube pressing plate may be swing without providing the above described cylindrical member around the through hole.

Preferably, the tube pump further comprises a ball bearing interposed between the drive shaft and the tube pressing member.

In this arrangement, the drive shaft and the tube pressing plate are coupled with each other with the aid of a ball bearing, and the tube pressing plate is swing through the rotation of the drive shaft. Accordingly, the device construction is simplified.

Preferably, the tube is fixed to the tube pressing member and the fixing member by either adhesive or welding.

In this arrangement, the pressing/expanding operation can be stably performed, after the assembling.

Preferably, the tube pressing member, the tube and the fixing member are integrally formed.

In this arrangement, the assembling work may be omitted.

Preferably, the tube pressing member is provided with a hole for holding a projection formed on the upper outer face of the tube. The fixing member is provided with a hole for holding a projection formed on the lower outer face of the tube.

In this arrangement, it is easy to mount the tube to the tube pressing member and the fixing member. A stable pressing/expanding operation is secured.

Alternatively, the tube and the fixing member are integrally formed. A hook member is formed on the upper outer face of the tube, which is engaged with an engagement member formed on the lower portion of the tube pressing member.

Alternatively, the tube includes an upper tube part and a lower tube part, which are connected to form a tube. An upper face of the upper tube part and the tube pressing member are integrally formed. A lower face of the lower tube part and the fixing member is integrally formed.

The tube may be made of a material having a relatively low self-restoring ability, or a material having a relatively low stiffness.

An aluminum tube, an aluminum tube coated with resin or laminated with a resin layer, or a vinyl tube may be used for the tube.

Thus, a tube pressing load is lessened, and the tube pump of high pump efficiency is realized.

Preferably, the tube pressing member always presses at least a part of the tube.

In this arrangement, there is no case that the backward flow of ink occurs. If it is not always pressed, it is necessary to provide a check valve for blocking the backward flow of ink.

According to the present invention, an ink jet recording apparatus may use the thus constructed tube pump as a pump unit for sucking ink from the recording head. In this case, the size of apparatus is reduced and the suction operation is stably and highly efficiently performed.

According to the present invention, an ink jet recording apparatus may use the thus constructed tube pump as an inky supplier for supplying ink from the main tank to the sub-tank. In this case, the size of apparatus is reduced and the ink supplying operation is stably and highly efficiently performed.

According to the present invention, there is also provided a tube pump, comprising:

a pump shaft, provided as a fixed central shaft;

a tube, wound around the pump shaft, the tube being deformable in a radial direction of the pump shaft;

an inner cylindrical member, for surrounding the tube therein;

an outer cylindrical member, being rotatable around the pump shaft, while defining an annular passage between the inner cylindrical member; and a ball body, provided in the annular passage while being movable therein in accordance with the rotation of the outer cylindrical member, wherein the inner cylindrical member is eccentrically swung by the movement of the ball body, while deforming the tube.

In this arrangement, when the outer cylindrical member is rotated about the pump shaft, the ball body rolls in the circumference direction of the pump shaft while pressing the outer surface of the inner cylindrical member. With the rolling, the inner cylindrical member swings in a plane perpendicular to the pump shaft.

In this case, the tube is pressed in the tube winding radial direction at a position at which the inner surface of the inner cylindrical member is closest to the outer surface of the pump shaft. At a position where it is furthest from the outer surface of the pump shaft, the tube is returned to its initial state.

Accordingly, an elastic force of the tube per se is not needed for the restoring of the tube in shape. Because of this, a design strictness in selecting the inside and outer diameters of the tube is lessened, and the pump design is simplified.

The feature that the elastic force of the tube per se is not needed for the restoring of the tube in shape, implies that a material of the tube may be selected from among an increased variety of materials. In this sense, a design freedom is increased in selecting the tube. Accordingly, a metal material, e.g., aluminum, may be used as a tube material.

Additionally, the fact that the tube is able to resuming its initial state or shape through the swing motion of the inner cylindrical member implies that there is no need of using a material having a large self-restoring ability for the tube material. Accordingly, the pressing load is reduced and the pump efficiency is increased.

Further, the restoration of the tube to the initial state is performed through the swing motion of the inner cylindrical member. Therefore, there is no need of taking a measure for preventing a trouble caused by the tube clinging or the like, which inevitably occurs in the related technique. Also in this point, the pump design is simplified.

Preferably, grooves are formed on an inner face of the outer cylindrical member and an outer face of the inner cylindrical member, for guiding the movement of the ball body.

When the outer cylindrical member rotates, the ball body reliably rolls along the groove in the outer surface of the inner cylindrical member. A stable swing of the swing cylinder is secured.

Preferably, an inner peripheral portion of the tube is integrated with an outer face of the pump shaft. An outer peripheral portion of the tube is integrated with an inner face of the inner cylindrical member.

In order to the same advantageous effects, according to the present invention, there is also provided a tube pump, comprising:

a pump shaft, provided as a rotary central shaft;

an inner cylindrical member, for defining an annular passage between the pump shaft;

a tube, wound around the inner cylindrical member, the tube being deformable in a radial direction of the pump shaft;

an outer cylindrical member, being fixed with respect to the pump shaft, while surrounding the tube therein; and a ball body, provided in the annular passage while being movable therein in accordance with the rotation of the pump shaft, wherein the inner cylindrical member is eccentrically swung by the movement of the ball body, while deforming the tube.

In this arrangement, when the pump shaft is rotated, the ball body rolls in the circumference direction of the pump shaft while pressing the inner surface of the inner cylindrical member. With the rolling, the inner cylindrical member swings in a plane perpendicular to the pump shaft.

In this case, the tube is pressed in the tube winding radial direction at a position at which the inner surface of the inner cylindrical member is closest to the inner surface of the outer cylindrical member. At a position where it is furthest from the inner surface of the outer cylindrical member, the tube is restored to its initial state or shape.

Preferably, grooves are formed on an inner face of the inner cylindrical member and an outer face of the pump shaft, for guiding the movement of the ball body.

Preferably, an inner peripheral portion of the tube is integrated with an outer face of the inner cylindrical member. An outer peripheral portion of the tube is integrated with an inner face of the outer cylindrical member.

In order to attain the same advantageous effects, according to the present invention, there is also provided a tube pump, comprising:

a pump shaft, provided as a fixed central shaft;

a first cylindrical member, being rotatable around the pump shaft;

a second cylindrical member, for defining an annular passage between the first cylindrical member;

a tube, wound around the second cylindrical member, the tube being deformable in a radial direction of the pump shaft;

a third cylindrical member, being fixed with respect to the pump shaft while surrounding the tube therein; and a ball body, provided in the annular passage while being movable therein in accordance with the rotation of the first cylindrical member, wherein the second cylindrical member is eccentrically swung by the movement of the ball body, while deforming the tube.

In this arrangement, when the pump shaft rotates, then the ball body rolls in the circumference direction of the pump shaft while pressing the inner surface of the second cylindrical member. With the rolling, the second cylindrical member swings in a plane perpendicular to the pump shaft.

In this case, the tube is pressed in the tube winding radial direction at a position at which the outer surface of the swing cylinder is closest to the inner surface of the third cylindrical member. At a position where it is furthest from the inner surface of the third cylindrical member, the tube is restored to its initial state or shape.

Preferably, grooves are formed on an inner face of the second cylindrical member and an outer face of the first cylindrical member, for guiding the movement of the ball body.

Preferably, an inner peripheral portion of the tube is integrated with an outer face of the second cylindrical member. An outer peripheral portion of the tube is integrated with an inner face of the third cylindrical member.

In the above tube pumps, it is preferable that the tube is taken out in an axial direction of the pump shaft.

In this arrangement, the take-out portion of the tube may be disposed at the pump shaft (fixed rotation center) or the fixed cylindrical member when the pump is assembled.

Alternatively, the tube is taken out in the radial direction of the pump shaft.

In this arrangement, the take-out portion of the tube may be disposed at a position as viewed in the radial direction of the fixed cylindrical member.

Preferably, the ball body always presses at least a part of the tube.

In this arrangement, there is no case that the backward flow of ink occurs if it is not always pressed, it is necessary to provide a check valve for blocking the backward flow of ink.

Preferably, the tube is made of a material having a relatively low self-restoring ability, or a metal having a stiffness which is deformable by the ball body.

In this arrangement, the pressing load to the tube is lessened, and the pump efficiency is increased.

An aluminum tube, an aluminum tube coated with resin or laminated with a resin layer, or a vinyl tube may be used for the tube.

Preferably, a friction resistance of an inner surface of the tube is larger than a friction resistance of an outer surface of the tube.

In this arrangement, fluid (air) smoothly flows within the tube.

Preferably, the tube is interposed through use of either adhesive or welding.

In this arrangement, the tube, the swung cylindrical member and the pump shaft or the fixed cylindrical member are firmly coupled.

According to the present invention, an ink jet recording apparatus may use the thus constructed tube pump as a pump unit for sucking ink from the recording head. In this case, the pump design is simple, and a design freedom is increased in selecting the tube, and the pump efficiency is improved.

According to the present invention, an ink jet recording apparatus may use the thus constructed tube pump as an inky supplier for supplying ink from the main tank to the sub-tank. In this case, the pump design is simple, and a design freedom is increased in selecting the tube, and the pump efficiency is improved.

DESCRIPTION OF THE PREFERRED EMBODIMENTS

Figure 1:
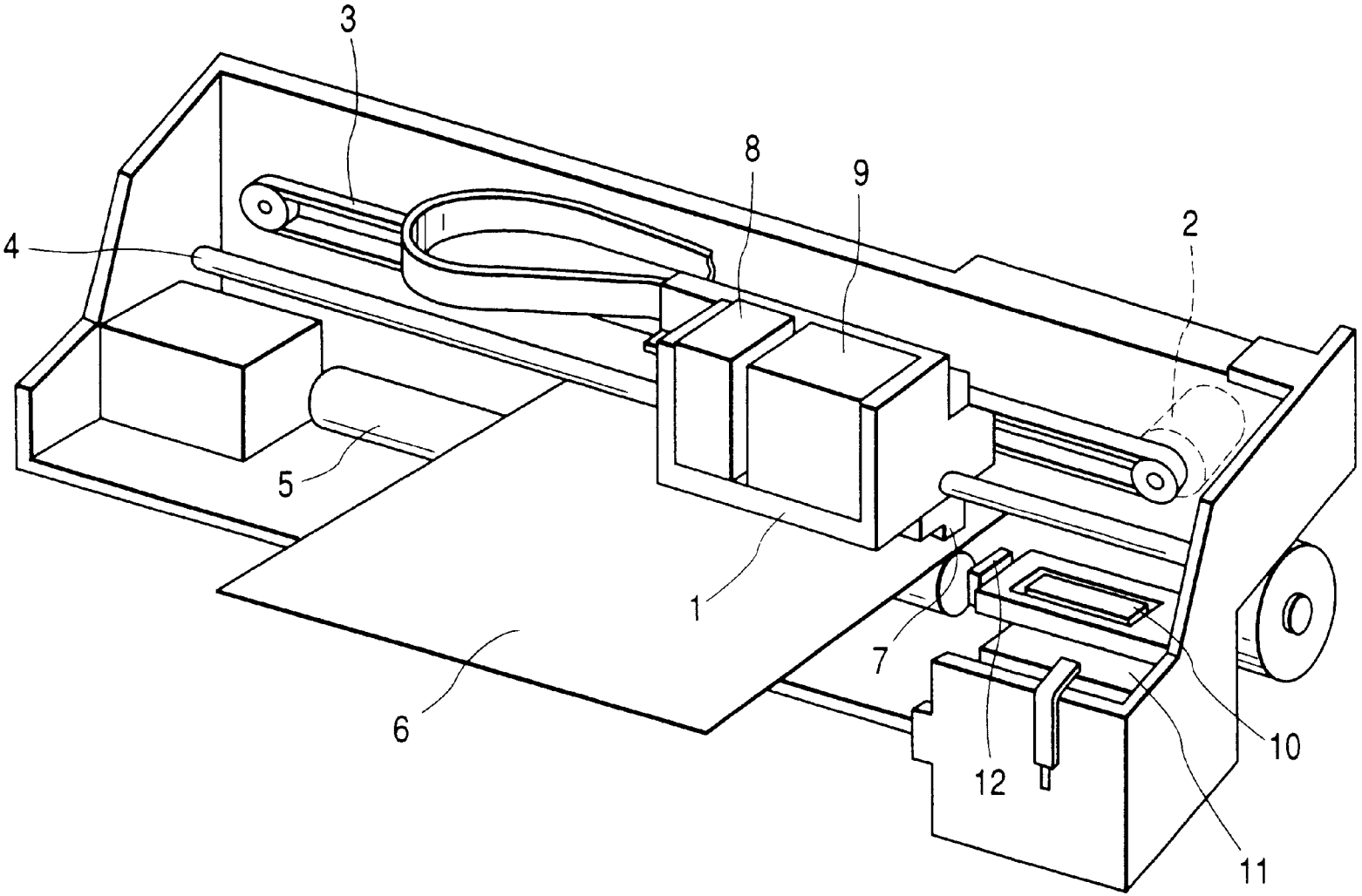
FIG. 1 is a perspective view showing an overall construction of an ink jet recording apparatus incorporating the present invention therein.

An ink jet recording apparatus which uses a tube pump for restoring an ink-ejection capability, which is constructed according to the present invention, will be described with reference to the accompanying drawings. FIG. 1 is a perspective view showing an overall construction of an ink jet recording apparatus incorporating the present invention thereinto.

In FIG. 1, reference numeral 1 denotes a carriage. The carriage 1, while being guided, is reciprocately moved in the axial directions of a platen 5 with the aid of a timing belt 3 driven by a carriage motor.

An ink jet recording head 7 is mounted on the side of the carriage 1, which is confronted with a recording sheet 6. A black ink cartridge 8 and a color ink cartridge 9, which are for supplying ink to the recording head are detachably attached to the upper side of the head.

In the figure, reference numeral 10 denotes a capping unit located at a non-recording region (home position). When the recording head mounted on the carriage 1 moves to right above the capping unit, the capping unit lifts and sealingly caps the nozzle face of the recording head with itself. A tube pump 11 as a pump unit for supplying a negative pressure to an inside space of the capping unit 10 is located under the capping unit 10. The tube pump 11 will be described in detail later. The capping unit 10 serves as a cover member for preventing the nozzle orifices of the recording head from being dried during a rest period of the ink jet recording apparatus. The tube pump also serves as an ink receptacle when the recording head is put in a flushing mode in which a drive signal having no connection with the recording operation is applied to the recording head to cause the recording head to eject ink in an idling manner. Further, it serves as a cleaning means which applies a negative pressure, which is derived from the tube pump 11, to the recording head, and absorbs ink.

A wiper 12 is horizontally movably provided near the side of the capping unit 10 which is closer to a recording region. The wiper is provided with an elastic plate made of rubber or the like. The wiper may advance to a traveling moving path of the recording head when the carriage 1 moves to and from the capping unit 10.

Figure 2:
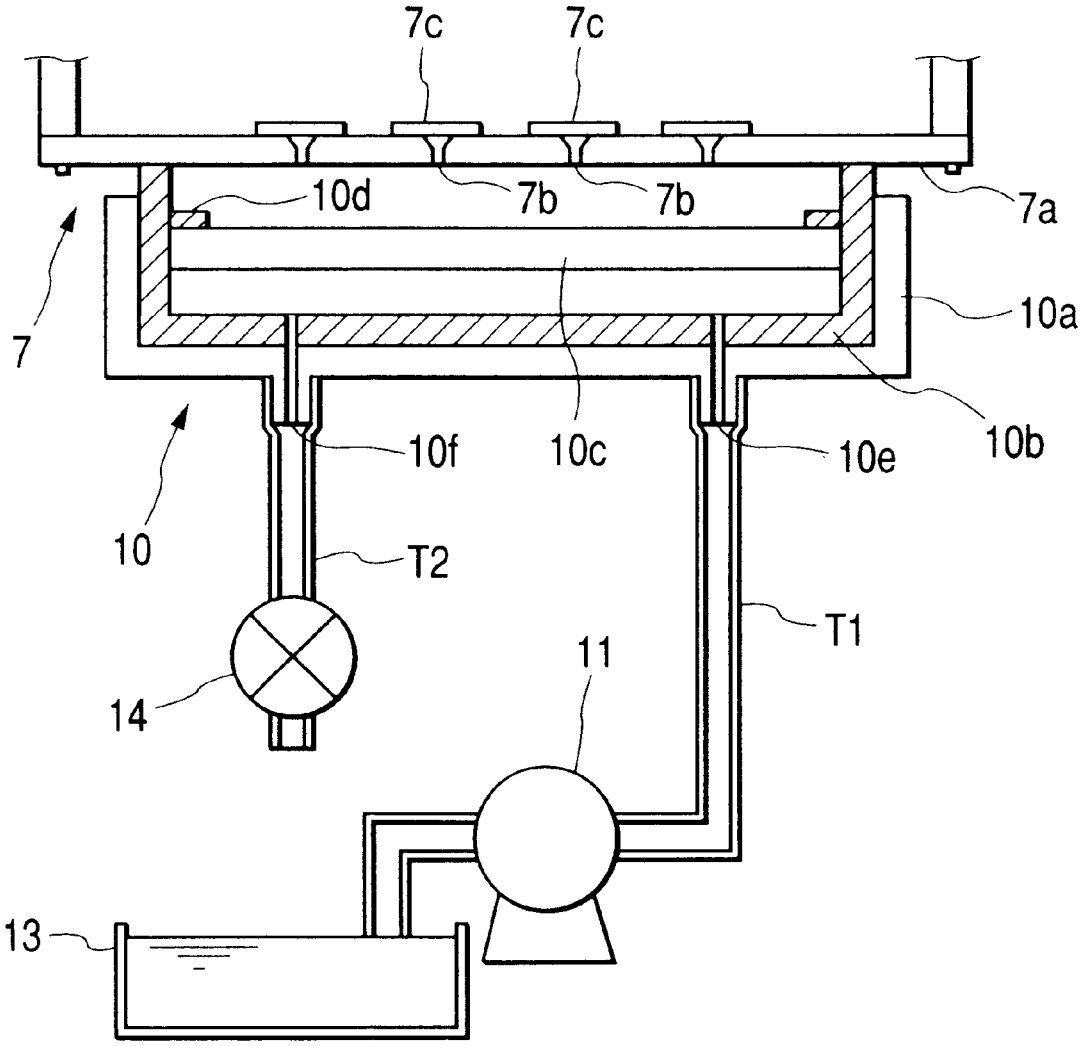
FIG. 2 is a sectional view showing a capping member and a tube pump, which are incorporated into the recording apparatus of FIG. 1.

A relationship between the tube pump 11 and the capping unit 10 will be described with reference to FIG. 2. FIG. 2 schematically illustrates a structure of the ink jet recording apparatus shown in FIG. 1, which includes the capping unit 10, the tube pump 11 connected to the capping unit and others.

The capping unit 10 includes a rectangular cap case 10*a* opened at the top, and a cap member 10*b* which is made of a flexible material, such as rubber, and contained in the cap case 10*a*. The cap member 10*b* somewhat protrudes above and its top is somewhat higher than the cap case 10*a*. An ink absorbing member 10*c* made of porous material is placed on the bottom in the cap member 10*b*, and held with a holder member 10*d*, which is formed integrally with the cap member 10*b*.

A suction port 10*e* and an air release port 10*f* are formed in the bottom of the cap case 10*a* while passing through the cap case 10*a* and the cap member 10*b*. The tube pump 11 is connected to the suction port 10*e* of the cap case 10*a* via a tube T1. A discharge end of the tube pump 11 is connected to the ink absorbing material contained in a used ink tank 13, as will be described later. An air release valve 14 is connected to an air release port 10*f* of the cap case 10*a* via another tube T2.

In FIG. 2, reference numeral 7 denotes a recording head. The recording head 7 is arranged such that it moves with movement of the carriage, and when it reaches a position above the capping unit 10, the nozzle face 7*a* of it is capped with the cap member 10*b*. A number of nozzle orifices 7*b* are formed in the nozzle face 7*a* of the recording head. Piezoelectric vibration elements 7*c* are respectively disposed in association with nozzle orifices 7*b*. When those piezoelectric vibration elements are selectively driven, color inks of black, yellow, cyan and magenta are selectively ejected from the nozzle orifices.

In the ink jet recording apparatus thus constructed, the operation to discharge air bubbles left in the recording head or the ink supplying passage and the ink sucking operation to remove the clogging of the nozzle orifice or orifices are performed in a state that, as shown in FIG. 2, the cap member 10*b* is brought into close contact with the nozzle face 7*a* of the print head 7, and the air release valve 14 is closed.

In this state, the tube pump 11 is driven, a negative pressure is applied to the inside space of the cap member 10*b*, and ink is sucked and discharged through the nozzle orifices 7*b* of the print head 7. The drive of the pump is continued for a predetermined time period, and then stopped. When the negative pressure within the cap member will reduce by a certain value of pressure. At this time, the air release valve 14 is opened. In turn, air is introduced into the cap member, and the negative pressure disappears. Subsequently, the tube pump 11 is driven again in a state that the air release valve 14 is left open. And the ink discharged into the cap member is fed through a tube T1 to a used ink tank 13.

A mechanical arrangement of the tube pump 11 according to a first embodiment of the invention will be described with reference to FIG. 3. As shown, the tube pump 11 is made up of a drive shaft 21, a rotary disc 22, a tube pressing plate 23, a metal ball 24, and a tube 25. The rotary disc 22 as an elastic rotary body is fastened to the drive shaft 21. The tube pressing plate 23 serving as a tube pressing member is swingable facing the rotary disc 22. The metal ball 24 serving as a swinging member is interposed between the rotary disc 22 and the tube pressing plate 23, and presses downward the tube pressing plate 23. The upper side of the tube 25 is fixed to the tube pressing plate 23, while the lower side thereof is fixed to the case.

The drive shaft 21 is provided with a flange 21*a*. The rotary disc 22 is fastened to the flange 21*a* by fastening members 28, such as screws. It is rotated with rotation of the drive shaft 21. The rotary disc 22 is made of an elastic material, such as metal, and generates a force to press downward the tube pressing plate 23 through the metal ball 24.

A groove 23*a*, shaped like V in cross section, is formed in the upper surface of the tube pressing plate 23. The metal ball 24 is rollable within the groove. A through hole 23*b* through which the drive shaft 21 passes is formed in a central part of the tube pressing plate 23. A tapered portion 23*c* whose diameter gradually reduces is formed at the top end portion of the through hole 23*b*. A hole 23*d* being fixed in diameter is formed continuous to the tapered portion 23*c*. A peripheral wall 23*e* whose top part is arcuate is formed around the rear end of the through hole 23*b*. The peripheral wall 23*e* comes in contact with the case 26.

Through holes 23*f* are formed in the lower side of the tube pressing plate 23. Those are used for fixing engaging protrusions 25*a* protruded from the top wall of the tube 25. The through hole 23*f* is continuously formed along the tube 25.

Through holes 26*a* are formed in the case 26, and are used for fixing engaging protrusions 25*b* protruded from the lower wall of the tube 25.

The tube 25, unlike the related one, may be made of a material, which does not have a self-restoring ability or a low stiffness, viz., a material having an elasticity. An aluminum tube, an aluminum tube coated with resin or laminated with a resin layer, or a vinyl tube may be used for the tube 25.

Since the self-restoring ability is not required for the material of the tube, the tube 25 may be thin.

Operations of the tube pump 11 will be described with reference to FIGS. 3 to 5.

Figure 3:
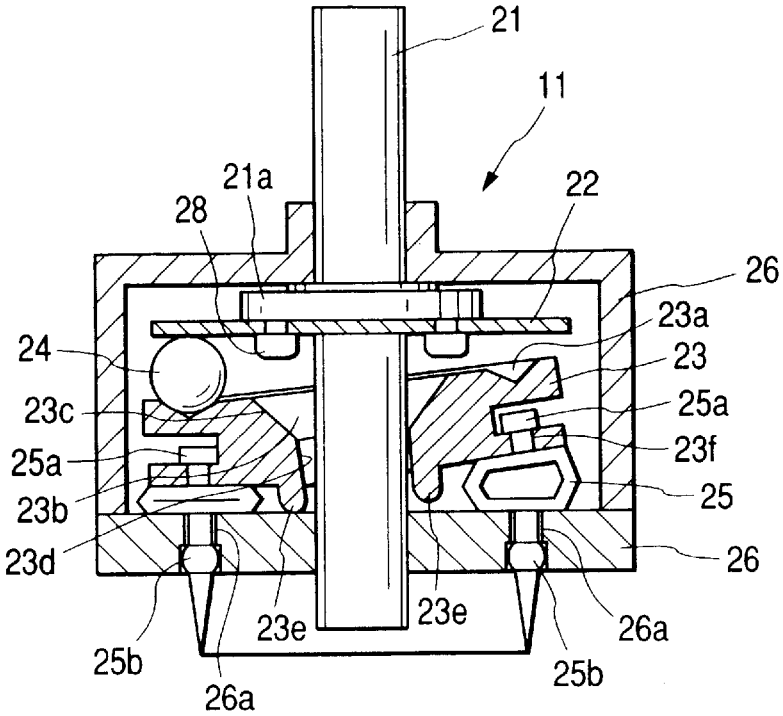
FIG. 3 is a cross sectional view showing a tube pump according to a first embodiment of the present invention.
Figure 4:
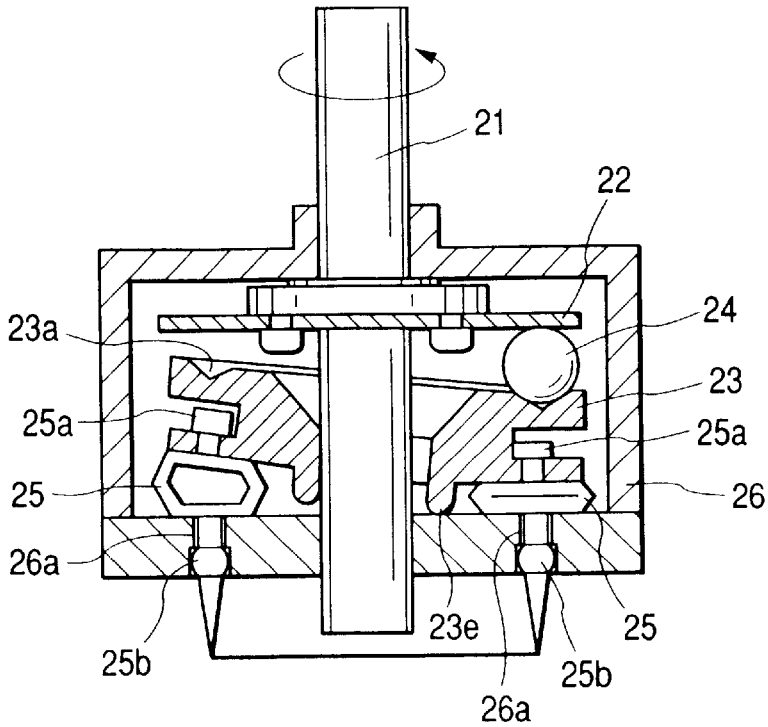
FIG. 4 is a cross sectional view showing the tube pump of FIG. 3, when it is in operation.

When the drive shaft 21 is rotated in the direction of an arrow, from a state shown in FIG. 3, the metal ball 24 moves into the V-shaped groove 23*a* of the upper side of the tube pressing plate 23, with rotation of the drive shaft 21. At this time, the metal ball 24 is held down with the rotary disc 22. Accordingly, the tube pressing plate 23 is moved from the upper position to the lower position, while being slanted.

When the metal ball 24 moves and is positioned, the tube pressing plate 23 slants (swings) from the upper position to the lower position to press the tube 25 flat for its closing. The metal ball 24, as described above, successively moves, so that the tube pressing plate 23 successively slants (moves) from the upper position to the lower position, so that the tube is gradually pressed and becomes substantially flat.

Since the upper and lower walls of the tube 25 are fastened to the tube pressing plate 23 and the case 26, respectively, the tube pressing plate 23 moves from the upper position to the lower position as the metal ball 24 becomes more distant. With the movement of the tube pressing plate, the tube 25 gradually resumes its initial shape from the pressed state.

Thus, the tube 25 resumes its initial shape through the action of the tube pressing plate 23. Therefore, as described above, the tube 25 is able to perform a desired sucking operation, even if it is made of a material not having a self-restoring ability or is thin in thickness.

Figure 5:
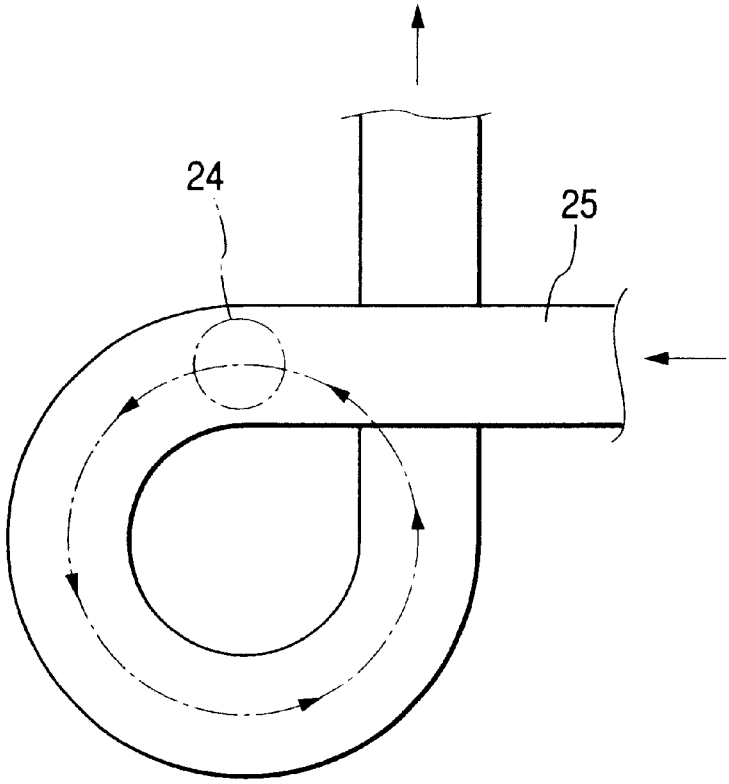
FIG. 5 is a diagram schematically showing an operation of the tube pump of FIG. 3.

As a result, as shown in model form in FIG. 5, the metal ball 24 successively moves (swings) the tube pressing plate 23, so that a negative pressure is applied to the inside space of the cap member 10*b*, and ink is sucked and discharged through the nozzle orifices 7*b* of the print head 7.

After the tube pump 11 is driven for a fixed time, the drive shaft 21 is stopped in rotation. Thereafter, at a time point where the negative pressure reduces by a certain value of pressure, the air release valve 14 is opened. Then, air is introduced into the cap member and the negative pressure disappears. Subsequently, the drive shaft 21 is rotated again while the air release valve 14 is left open. And ink discharged into the cap member is fed to the used ink tank 13.

Figure 6:
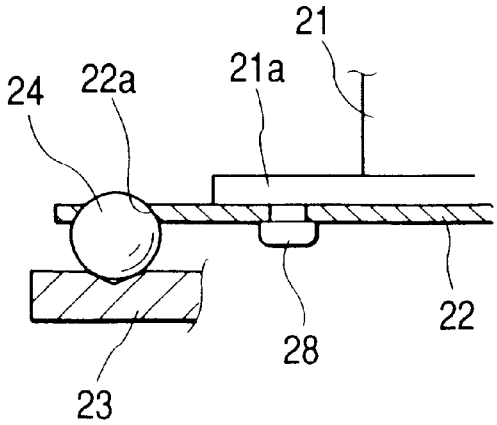
FIG. 6 is a cross sectional view showing a tube pump according to a second embodiment of the invention.

FIG. 6 shows a tube pump according to a second embodiment of the invention. In this embodiment, a fitting hole 22*a*, which receives a part of the metal ball 24, is bored in the rotary disc 22. With provision of the fitting hole 22*a* which receives a part of the metal ball 24, a rotation of the drive shaft 21 is completely transmitted to the metal ball 24. Upon receipt of the rotation, the metal ball 24 slants the tube pressing plate 23 as a tube pressing member.

Figure 7:
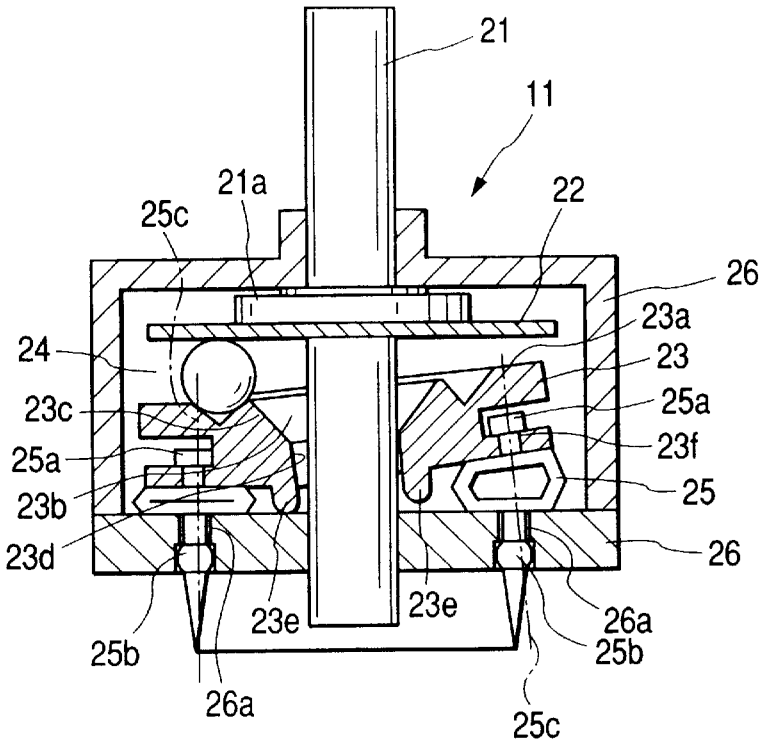
FIGS. 7 and 8 are cross sectional views showing a tube pump according to a third embodiment of the invention.
Figure 8:
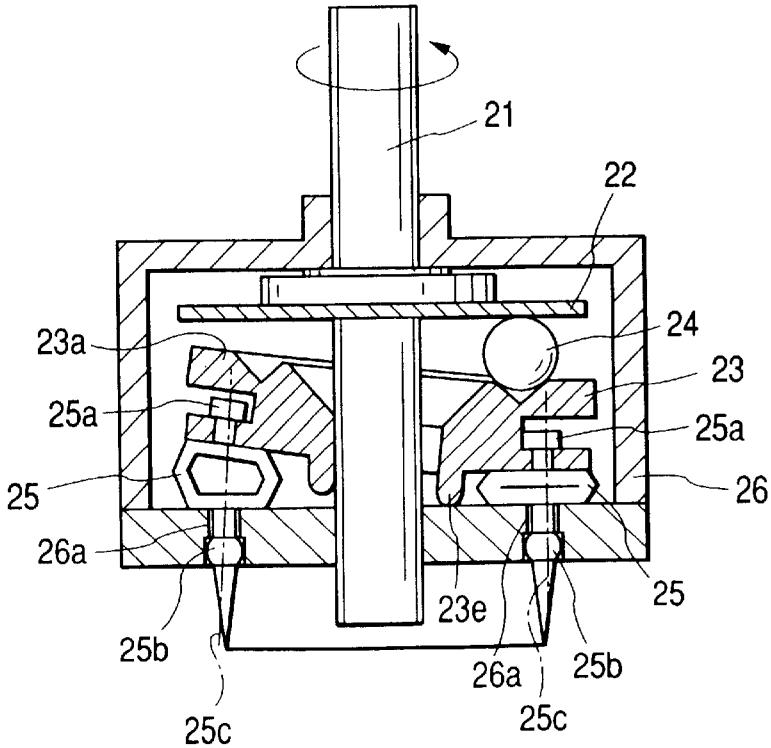

FIGS. 7 and 8 show a tube pump according to a third embodiment of the invention. In this embodiment, a groove, which receives the swinging member in a fitting fashion, is formed in the upper surface of the tube pressing plate. The center of the groove is formed at a position which is closer to the drive shaft than the center of the cross section of the tube.

Thus, the groove 23*a* having a V-shaped cross section is formed at a position which is closer to the drive shaft 21 than a center 25*c* of the cross section of the tube 25. A pressing force of the tube pressing plate 23 to press the tube 25 is uniformly exerted on the tube 25 during the tube pressing. Accordingly, the quantity of the tube pressing for closing the tube 25 and a pressing load may be reduced. Further, the closing state of the tube may be kept stably at all times. Therefore, the driving (slanting) operation of the tube pressing plate is stable. Consequently, the size reduction and high efficiency of the ink jet recording apparatus are secured.

Figure 9:
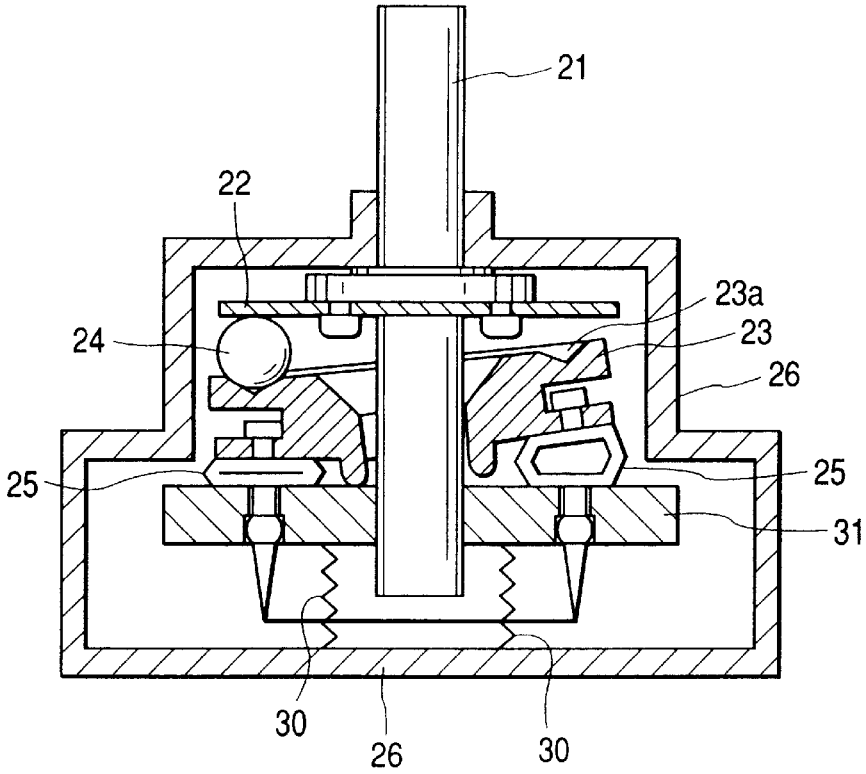
FIG. 9 is a cross sectional view showing a tube pump according to a fourth embodiment of the invention.

FIG. 9 shows a tube pump according to a fourth embodiment of the invention. In the embodiment, the pressing force of the metal ball 24 against the tube pressing plate 23, which is generated by an elasticity of the rotary disc 22, is generated by a tube fixing plate 31.

Specifically, as shown in FIG. 9, a spring 30 is interposed between the tube fixing plate 31 and the case 26. The tube fixing plate 31 presses the tube 25 toward the tube pressing plate 23 with the aid of the spring. In this case, it is better to use a strong rotary disc for the rotary disc 22 since it receives the pressing force.

Figure 10:
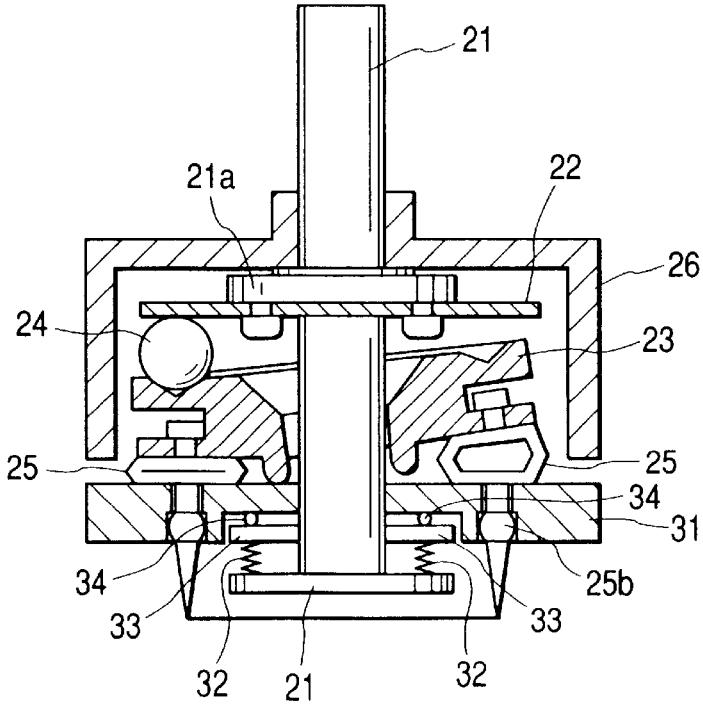
FIG. 10 is a cross sectional view showing a tube pump according to a fifth embodiment of the invention.

FIG. 10 shows a tube pump according to a fifth embodiment of the invention. In this embodiment, a spring 32 is placed between the tube fixing plate 31 and the drive shaft 21.

Specifically, as shown in FIG. 10, a flange 21*b* is formed around the bottom end of the drive shaft 21. A spring 32 is placed between the flange 21*b* and a spring engaging plate 33. A ball bearing 34 is provided between the spring engaging plate 33 and the tube fixing plate 31.

With such a structure, the spring engaging plate 33 and the tube fixing plate 31 press upward the tube fixing plate 31, and in turn the tube fixing plate 31 presses the tube 25 toward the tube pressing plate 23. When the drive shaft 21 is rotated, the spring engaging plate 33 also rotates together with the shaft.

While in the above-mentioned embodiments, the metal ball is used as the swinging member, the metal ball may be replaced with a protrusion protruded from the rotary disc toward the tube pressing plate. Additionally, a cylindrical member, such as a roller, may be used instead of the metal ball. The material of the swinging member is not limited to metal, but may be resin. In the embodiments mentioned above, the drive shaft and the rotary disc are separately provided. Instead, a unitary member may be used.

Figure 11:
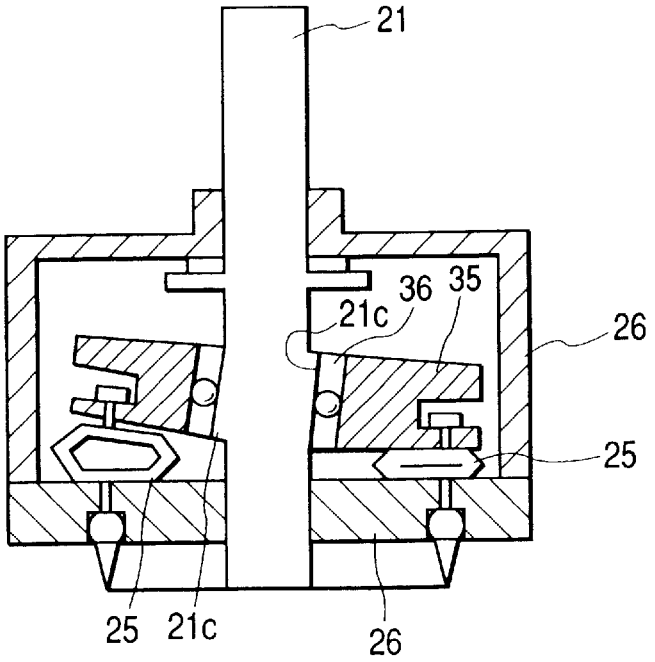
FIG. 11 is a cross sectional view showing a tube pump according to a sixth embodiment of the invention.

FIG. 11 shows a pump tube according to a sixth embodiment of the invention. In the embodiment, the rotary disc 22 and the metal ball 24 are omitted, thereby simplifying the device structure.

The tube pump is made up of a drive shaft 21, a tube pressing plate 35 which is slidable with rotation of the drive shaft 21, and a tube 25 whose upper wall is fixed to the lower side of the tube pressing plate 35, and lower wall is fixed to the case. The drive shaft and the tube pressing plate 35 are coupled with each other through a ball bearing 36. In particular, the drive shaft 21 includes a tapered portion 21*c*, which corresponds to a rotary body rotating together with the drive shaft. A ball bearing 36 is mounted on the tapered portion 21*c*.

With the structure, when the drive shaft 21 is rotated, the tube pressing plate 35 swings to gradually press the tube and the tube resumes its initial shape.

To press the tube by a fixed pressing force, it is preferable to form the tube pressing plate 35 by using an elastic material, e.g., a metal.

Figure 12:
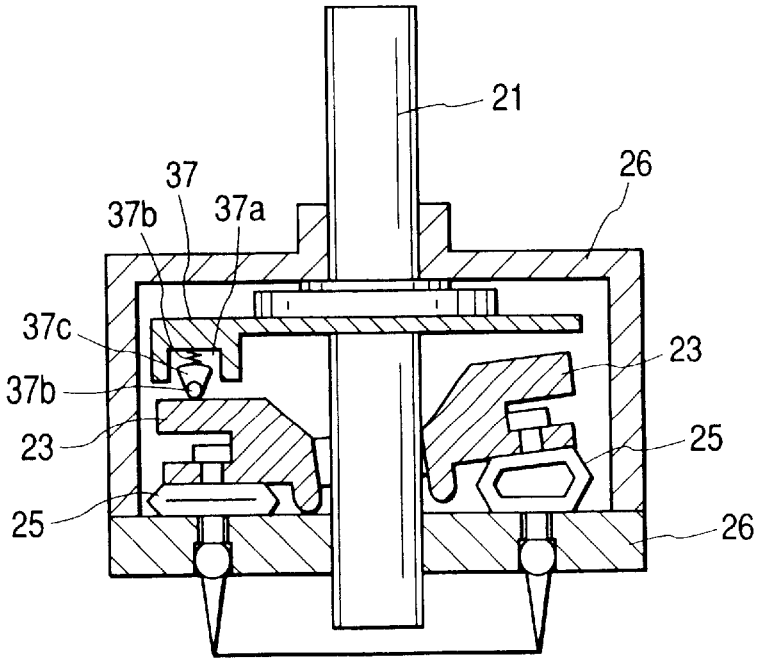
FIG. 12 is a cross sectional view showing a tube pump according to a seventh embodiment of the invention.
Figure 13A:
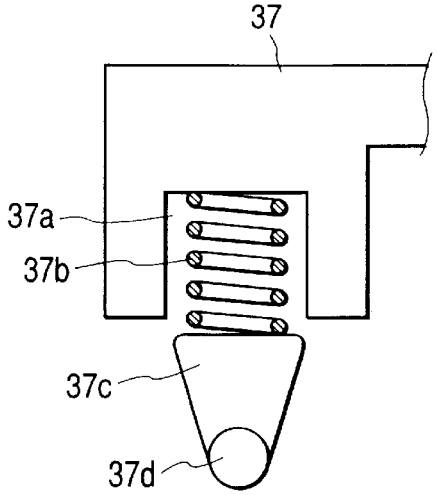
FIGS. 13A and 13B are enlarged views showing an essential portion of the tube pump of FIG. 12.
Figure 13B:
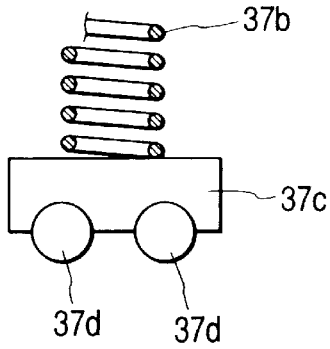

FIGS. 12, 13A and 13B show a pump tube according to a seventh embodiment of the invention in the embodiment, the rotary disc 22 and the metal ball 24 are altered.

In the tube pump, a recess 37*a* is formed in the lower side of a rotary disc 37, as a rotary body, which is fastened to the drive shaft 21 and rotated together with it. A spring 37*b* is fixed at one end to the bottom of the recess 37*a*. The other end of the spring 37*b* is fixed to the upper side of a holder member 37*c*. A ball 37*d* is held on the lower side of the holder member 37*c*. The ball, while pressing, slides on the tube pressing plate 23. One or two balls 37*d* are arranged in the sliding direction.

Accordingly, when the drive shaft 21 rotates, the ball 37*d* slides while pressing the tube pressing plate 23. In turn, the tube pressing plate 23 swings, the tube 25 is gradually pressed to be closed, and takes again its initial shape.

In the embodiment, there is no necessity for using an elastic material, e.g., a metal, for forming the rotary disc 37. That is, under pressure of the spring 37*b*, the ball 37*d* acts on the tube pressing plate 23 by a fixed pressing force. Accordingly, the tube 25 is pressed to be flat, by a fixed pressing force.

Figure 14:
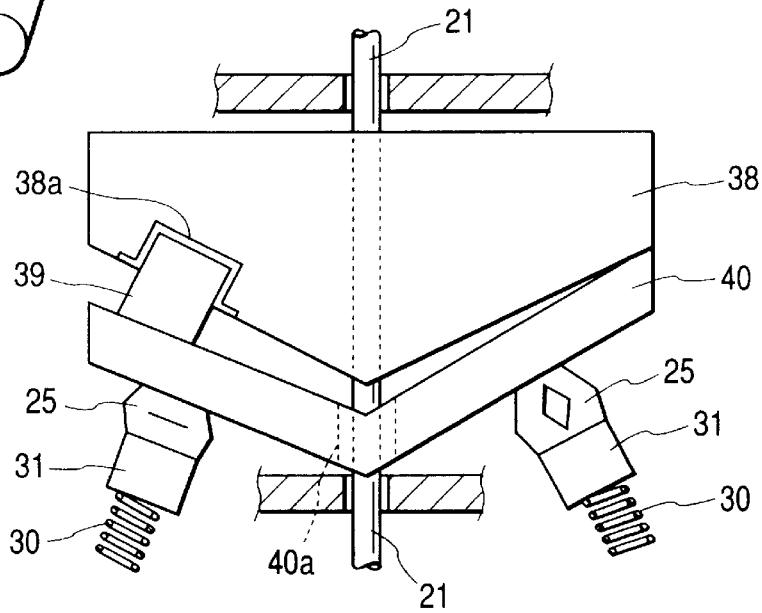
FIG. 14 is a cross sectional view showing a tube pump according to an eighth embodiment of the invention.

FIG. 14 shows a tube pump according to an eighth embodiment of the invention. In this embodiment, the rotary disc 22, the metal ball 24 and the tube pressing plate 23 are altered.

The tube pump is provided with a rotary conical body 38 which is fastened to the drive shaft 21 and rotates together with the latter. A recess 38*a* is formed in a slanted surface of the rotary conical body 38. A frustum body 39 is held which slides on a tube pressing plate 40 while pressing the latter. The tube pressing plate 40 is conical in shape. The drive shaft 21 is mounted passing through the vertex of the conical tube pressing plate 40, and the tube pressing plate is swingable with the vertex as its swing center. Specifically, the drive shaft 21 loosely passes through a through hole 40*a* so as to allow the tube pressing plate 40 to swing.

The axial line of the frustum body 39 is parallel to the generatrix of the rotary conical body 38. The frustum body 39 moves while rotating and pressing the tube pressing plate 40 with its side wall.

The tube fixing plates 31 are provided only at the portions at which the cylinders 25 are located, and springs 30 are located under the tube fixing plates 31.

Accordingly, when the drive shaft 21 is rotated, the frustum body 39 moves on the tube pressing plate 40 while rotating and pressing the tube pressing plate. As a result, the tube pressing plate 40 swings to gradually press the tube 25 flat and the tube resumes its initial shape.

Also in the embodiment, there is no necessity for using an elastic material, e.g., a metal, for forming the rotary conical body 38. That is, under pressure of the spring 30, a fixed pressing force acts on the tube 25 and the tube is pressed by a certain degree of pressing.

Figure 15:
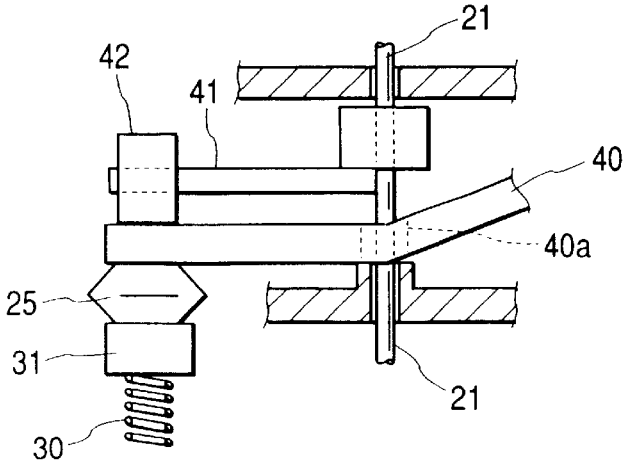
FIG. 15 is a cross sectional view showing a tube pump according to a ninth embodiment of the invention.

FIG. 15 shows a tube pump according to a ninth embodiment of the invention. In this embodiment, the rotary disc 22, the metal ball 24 and the tube pressing plate 23 are modified.

In this tube pump, a bar 41 is provided which is fastened to the drive shaft 21 and rotates together with the drive shaft 21. A cylindrical body 42 is located at the top of the bar 41. The cylindrical member rotates about the bar 41.

The tube pressing plate 40 is conical in shape. The drive shaft 21 passes through the vertex of the conical tube pressing plate, and the tube pressing plate is swingable with the vertex as its swing center.

The cylindrical body 42 moves while pressing the tube pressing plate 40 with its side face and rotating.

Further, the tube fixing plate 31 is provided only at a portion at which the tube 25 is located. The spring 30 is disposed under the tube fixing plate 31.

Accordingly, when the drive shaft 21 rotates, the cylindrical body 42 moves on the tube pressing plate 40 while rotating and pressing the tube pressing plate. As a result, the tube pressing plate 40 swings to gradually press the tube 25 to be flat and the tube resumes to its initial shape. Also in this embodiment, a fixed pressing force acts on the tube 25 by the spring 30, and the tube is pressed by a fixed degree of pressing.

Figure 16:
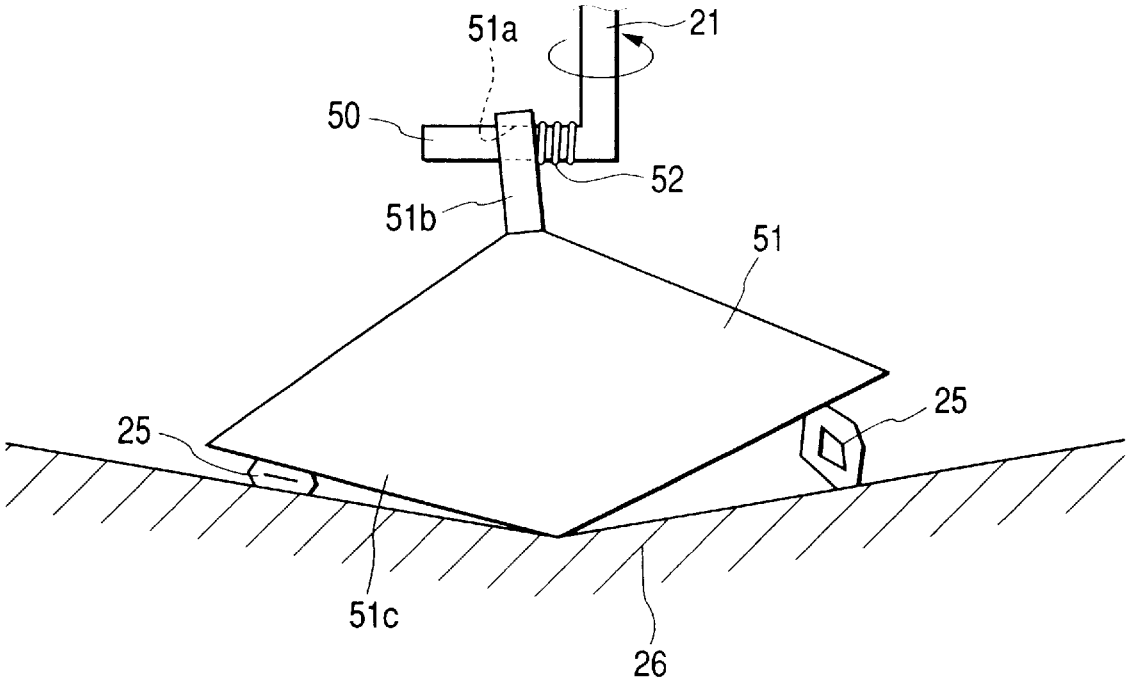
FIG. 16 is a cross sectional view showing a tube pump according to a tenth embodiment of the invention.
Figure 17A:
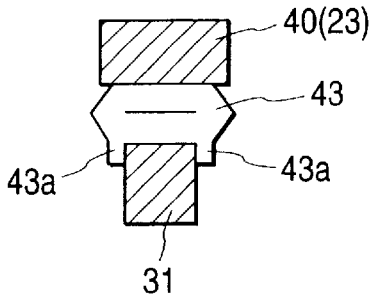
FIGS. 17A and 17B are cross sectional views showing a first modification of the tube.
Figure 17B:
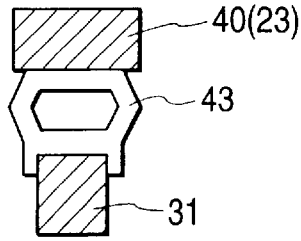

FIG. 16 shows a tube pump according to a tenth embodiment of the invention. In this embodiment, the rotary disc 22, the metal ball 24, the tube pressing plate 23 and the case 26 are altered.

In the tube pump, a bar 50 is provided which is fastened to the drive shaft 21 and rotates together therewith. The bar 50 is coupled to a tube pressing body 51 having a through hole 51*a* through which the bar 50 passes.

The lower part of the tube pressing body 51 is conical to form a tube pressing part 51*c*. A protrusion 51*b* with the through hole 51*a* formed therein is formed at the top of the tube pressing body 51.

A spring 52 is loosely coupled to the bar 50. One end of the spring 52 is fixedly set to the drive shaft 21, while the other end is fixedly set to the protrusion 51*b*. The tube pressing body 51 is put in a slanted state by the spring 52. In this state, the tube pressing body is rotated by the drive shaft 21.

The upper surface of the case 26 is conical to form a recess. Tubes 25 are placed on the conical upper surface of the case.

The bar 50 may be substituted by the rotary disc 22 which rotates together with the drive shaft 21 as shown in FIG. 3. In this case, a through hole is formed in the drive shaft 21, and the protrusion 51*b* of the tube pressing body 51 is loosely inserted into the through hole. Further, it is desirable to interpose a spring between the tube pressing body 51 and the rotary disc 22 so that the tube pressing body 51 presses the tube 25 by a fixed pressing force.

Accordingly, when the drive shaft 21 rotates, the tube pressing body 51 swings to gradually press the tube 25 flat and the tube resumes its initial shape. Also in this embodiment, by the spring 52*a* fixed pressing force is exerted on the tube 25 and the tube is pressed by a fixed degree of pressing.

In the embodiments mentioned above, as shown in FIGS. 3, 4, 7 and 9 through 12, the through hole is formed in the lower surface of the tube pressing plate. The protrusion of the upper wall of the tube is fixed to the through hole. The through hole is formed in the case or the tube pressing plate. The engaging protrusion provided on the lower wall of the tube is fixed to the through hole. In an alternative, other fastening manners, such as adhesive or welding, may be used for fastening the tube to the tube pressing plate, the case or the tube fixing plate.

Further, the tube pressing plate, the tube, the case or the tube fixing plate may be formed in a unit form.

Next, modifications of the tube will be described below.

FIGS., 17A and 17B show a first modification of the tube. In this modification, legs 43*a* are provided on the lower surface of a tube 43. Those legs hold the tube fixing plate 31 therebetween. With regard to the tube 43, an inner face of the tube, which is defined between the legs 43*a*, is fastened to the tube fixing plate 31 by adhesive. The upper wall of the tube 43 is bonded to the tube pressing plate 23 (40) by adhesive.

Thus, the legs 43*a* for holding the timing belt 3 are provided on the lower surface of the tube 43. Accordingly, the tube 43 can be firmly fixed.

Figure 18A:
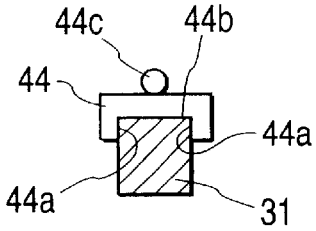
FIGS. 18A and 18B are cross sectional views showing a second modification of the tube.
Figure 18B:
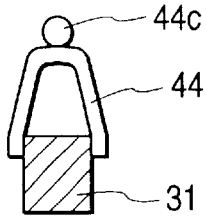

A second modification of the tube is shown in FIGS. 18A and 18B. The tube 44 is integrally formed on the upper part of the tube fixing plate 31 by one piece molding. Specifically, the inner wall 44*a* of the tube 44 is integral with the upper side wall of the tube fixing plate 31. The inner bottom wall 44*b* of the tube 44 is separable from the upper surface of the tube fixing plate 31. A hook 44*c* is formed on the upper surface (upper wall) of the tube 44. The hook is fixed to a protrusion (not shown) formed on the lower surface of the tube pressing plate.

Accordingly, as shown in FIG. 18B, when the hook 44*c* is pulled up, the tube 44 takes the form of a tube with a passage formed therein. When the hook 44*c* is returned to the original position, the tube 44 is deformed to be closed in the passage or flat as shown in FIG. 18A.

Thus, in the modification, in forming the tube fixing plate 31, the tube 44 is also formed together with it by one piece molding. Accordingly, the manufacturing cost of the tube is reduced. There is no need for the bonding work of bonding the tube fixing plate 31 to the tube.

Figure 19A:
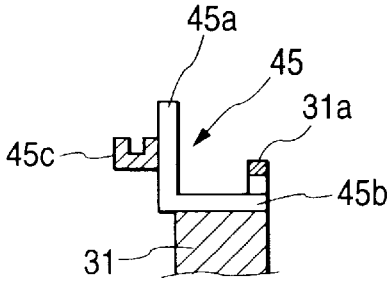
FIGS. 19A and 19B are cross sectional views showing a third modification of the tube.
Figure 19B:
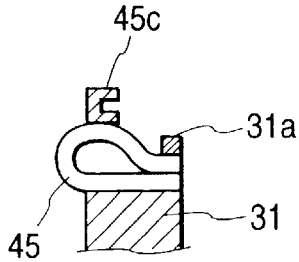

A third modification of the tube is shown in FIGS. 19A and 19B. The tube 45 is shaped like L. To form the tube 45, as shown, its upright portion 45*a* is curvedly bent and its top end is bonded to a bottom 45*b* by adhesive. Specifically, as shown in FIG. 19A, the bottom 45*b* of the tube 45 is fixed to the upper surface of the tube fixing plate 31. As shown in FIG. 19B, the upright portion 45*a* of the tube 45 is curvedly bent and the top end of the upright portion 45*a* is bonded to the bottom 45*b* by adhesive, whereby the tube 45 is formed.

As shown in FIG. 19B showing a state that the upright portion 45*a* is curvedly bent, a hook 45*c* is formed on the upper surface (upper wall) of the tube 44. The hook is fastened to a protrusion (not shown) provided on the lower surface of the tube pressing plate. The hook 45*c* is fixed integral with the tube 45.

The tube fixing plate 31 includes a holder portion 31*a* which holds the tip of the upright portion 45*a*. The end of the upright portion 45*a* is inserted into a space between the holder portion 31*a* and the bottom 45*b*, and the end of the upright portion 45*a* is bonded to the bottom 45*b* by adhesive. Whenever occasion demands, the end of the upright portion 45*a* may be press fit into the space between the holder portion 31*a* and the bottom 45*b*, instead.

It is preferable that the holder portion 31*a*, the end of the upright portion 45*a* and the bottom 45*b* are bonded together by adhesive. By thus bonding the holder portion 31*a* and the end of the upright portion 45*a* by adhesive, the tube is firmly fixed to the tube fixing plate 31.

Also in this tube, when the tube pressing plate swings, the hook 45*c* is pulled up and is returned to its original position, the tube 25 is gradually pressed flat and resumes its initial shape.

Figure 20A:
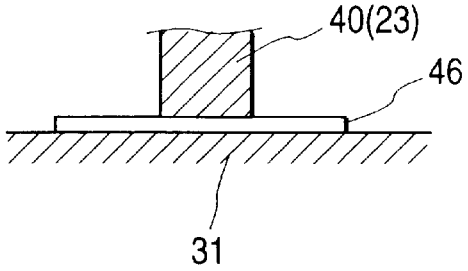
FIGS. 20A and 20B are cross sectional views showing a fourth modification of the tube.
Figure 20B:
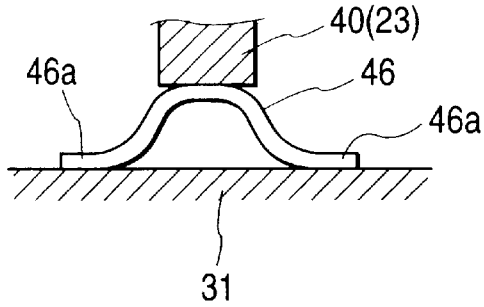

A fourth modification of the tube shown in FIGS. 20A and 20B is a flat tube 46. The tube is formed on the upper surface of the tube fixing plate 31 in a unitary fashion. Bottom side parts 46*a* of the flat tube 46 are integral with the tube fixing plate 31. A central portion 46*b* of the flat tube 46 is separable from the upper surface of the tube fixing plate 31. The upper surface of the flat tube 46 is secured to the lower surface of the tube pressing plate 40.

With such a structure, a fluid passage, called so, is formed between the flat tube 46 and the tube fixing plate 31. When the tube pressing plate 40 (23) swings, the flat tube 46 is gradually pressed to be flat, and takes again its initial shape.

When the tube fixing plate 31 is formed, the guide member 4 is formed by one piece molding, and accordingly, its manufacturing cost is low.

Figure 21:
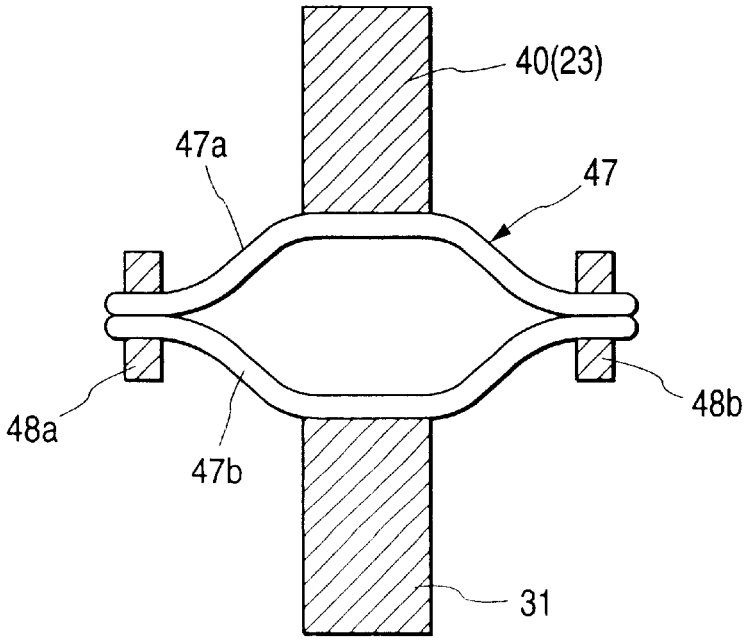
FIG. 21 is a cross sectional view showing a fifth modification of the tube.

A lower wall 47*b* of a tube 47 shown in FIG. 21, which is a fifth modification of the tube, is formed integral with the upper surface of the tube fixing plate 31, by one piece molding. An upper wall 47*a* of the tube 47 is formed integral with the lower surface of the tube pressing plate 40, by one piece molding.

As shown in FIG. 21, the upper wall 47*a* and the lower wall 47*b* of the tube 47 are bonded together by adhesive.

Then, those walls 47*a* and 47*b* are clamped together by fastening member 48*a*. In this case, the upper and lower walls 47*a* and 47*b*, and the fastening member 48*a* are preferably bonded by adhesive. If required, those walls 47*a* and 47*b* may be brought into press contact with each other by the fastening member 48*a*, instead.

Thus, the tube 47 is formed by bonding together the upper and lower walls 47*a* and 47*b* by adhesive. Through a swing motion of the tube pressing plate 40, the tube 47 is gradually pressed flat and is returned to its initial state.

In the tube thus constructed, in molding the tube fixing plate 31 and the tube pressing plate 40, the upper and lower walls 47*a* and 47*b* are also molded together with those plates by one piece molding. Accordingly, the manufacturing cost is low.

Figure 22:
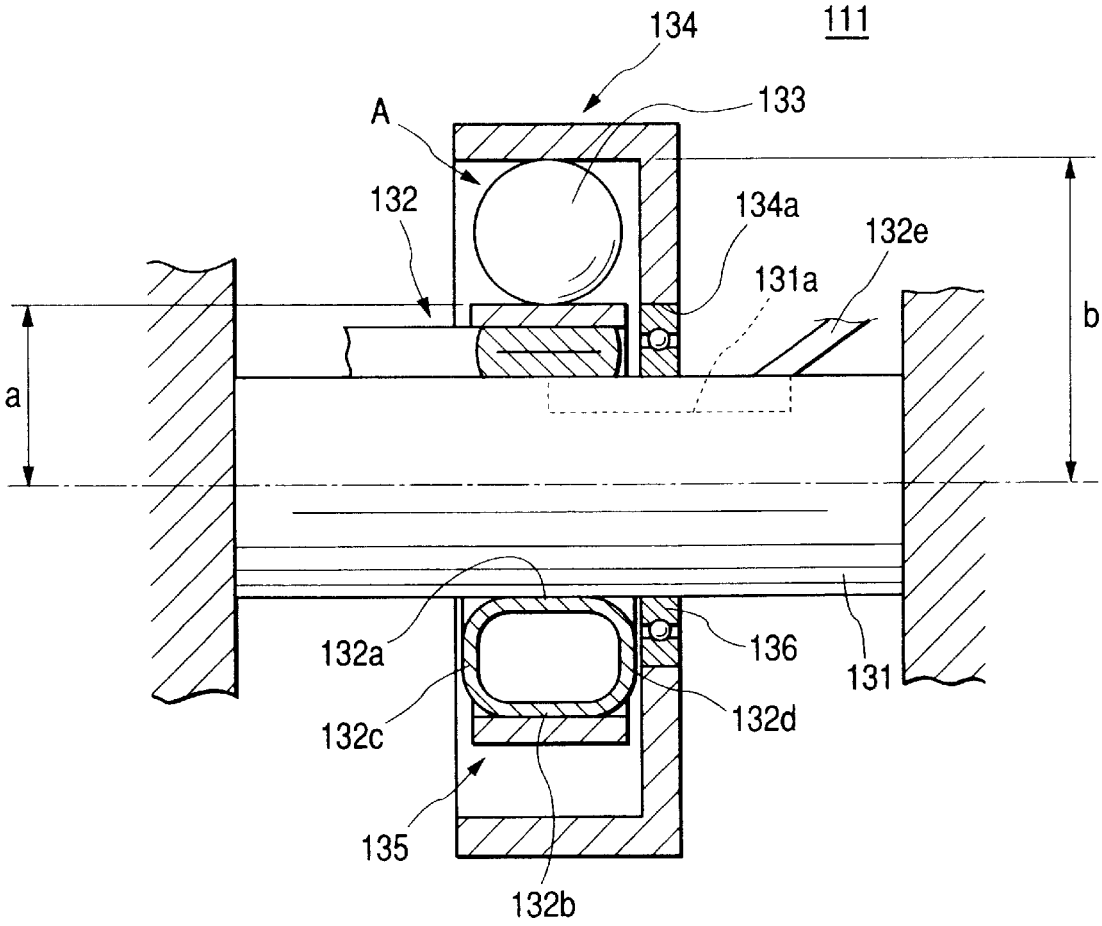
FIG. 22 is a cross sectional view showing a tube pump according to an eleventh embodiment of the invention.

A tube pump 111 according to an eleventh embodiment is schematically illustrated in FIG. 22.

The tube pump 111 includes a pump shaft 131 as a fixed central axis. A tube take-out path 131*a,* which axially extends, is formed in the pump shaft 131. A tube 132, while being wound in a ring-like fashion, is disposed around the pump shaft 131. The tube 132 is able to deform in the tube winding radial direction and to take its initial shape again.

The tube 132 is interposed between the outer surface of the pump shaft 131 and the circumferential inner surface of a swing cylinder to be described later. To be more specific, the inner and outer walls 132*a* and 132*b* of the tube 132 are fastened to the outer surface of the pump shaft 131 and the inner surface of the swing cylinder (to be described later) by an appropriate manner, such as adhesive, welding or fastening.

The tube 132 is made of a soft material being low in a self-restoring ability or a material having a low stiffness. More specifically, the tube may be made of a metal material of aluminum or the like, formed of an aluminum material whose surface is laminated with resin coating, or made of a synthetic resin of vinyl or the like. With this, a pressing load which acts on the tube 132 when the pump is driven, is lessened, and as a result, the pump efficiency is improved. A take-out portion 132*e* (a part thereof) of the tube 132 is located within the tube take-out path 131*a* of he pump shaft 131.

The tube 132 is preferably designed such that a difference between the inner diameter and the outer diameter of the tube 132 (circumference length difference) is as small as possible; otherwise, the self-restoring ability and the fluid pressure will act on the swing cylinder to be described later. Further, it is preferable that a friction resistance of the inner wall of the tube is small.

An rolling path A, while extending in the circumferential direction of the pump shaft 131, is disposed around the winding central axis (axial line of the pump shaft) of the tube 132. A ball body 133 is located within the rolling path A and rollable in the circumference direction of the pump shaft 131. The ball body 133 is made of metal or synthetic resin. Two cylinders 134 and 135, inner and outer cylinders, having different diameters are disposed on the inner and outer sides of the rolling path A for the ball body 133.

The inner diameter of the rolling path A is selected to be 2*a* (where "a" is the shortest distance from a tube pressing position (a position at which a pressure is applied to the swing cylinder) of the ball body 133 to the axial line of the pump shaft 131. The outer diameter of the rolling path A is selected to be 2*b* (where "b" is the sum of the outer diameter of the ball body 133 to the distance "a"). The width of the rolling path A is substantially equal to the outer diameter of the ball body 133.

Of the cylinders 134 and 135, the outer cylinder 134 is a tube (with the bottom), which is rotatable about the tube winding center axis (pump axis) when it is driven by drive means (not shown). It is rotatably mounted on the outer surface of the pump shaft 131. With such a structure, when the pump is operated and the cylinder 134 is rotated, a friction force generates between the inner surface of the cylinder 134 and the ball body 133. And the ball body 133 rolls on and along the outer surface of the outer cylinder 134, while being drawn in the rotational direction of the cylinder 134. A through hole 134*a* is formed in the bottom of the cylinder 134 at a mid-position as viewed in the longitudinal direction of the tube take-out path 131*a*, and it receives the ball bearing 136.

The inner cylinder 135 is a no-bottom cylinder serving as the swing cylinder, which swings with the rolling of the ball body 133, which is caused by the rotation of the outer cylinder 134. The inner cylinder 135 receives a pressing force of the ball body 133, and is held in a state that it presses part of the tube 132.

In order that with rotation of the outer cylinder 134 when the pump is operating (the outer cylinder 134 is rotating), the ball body 133 smoothly rolls within the rolling path A, the cylinders 134 and 135 are made of such a material as to develop a small friction force between the outer cylinder 134 and the ball body 133.

In the tube pump thus constructed, when the outer cylinder 134 is rotated about the pump shaft 131, the ball body 133, as shown in FIG. 22, rolls within the rolling path A in the circumference direction of the pump shaft 131 while pressing the outer surface of the inner tube body (swing cylinder) 135. With the rolling, the inner cylinder 135 swings in a plane perpendicular to the pump shaft 131.

In this case, when the ball body 133 presses the outer surface of the swing cylinder 135, the swing cylinder 135 moves in the radial direction of the pump shaft 131. The tube 132 is pressed (closed) in the tube winding radial direction at a position (upper side in FIG. 22) at which the inner surface of the inner cylinder 135 is closest to the outer surface of the pump shaft 131. At a position (lower side in FIG. 22) where it is furthest from the outer surface of the pump shaft 131, the tube 132 is returned to its initial state (it resumes its initial shape).

Figure 23:
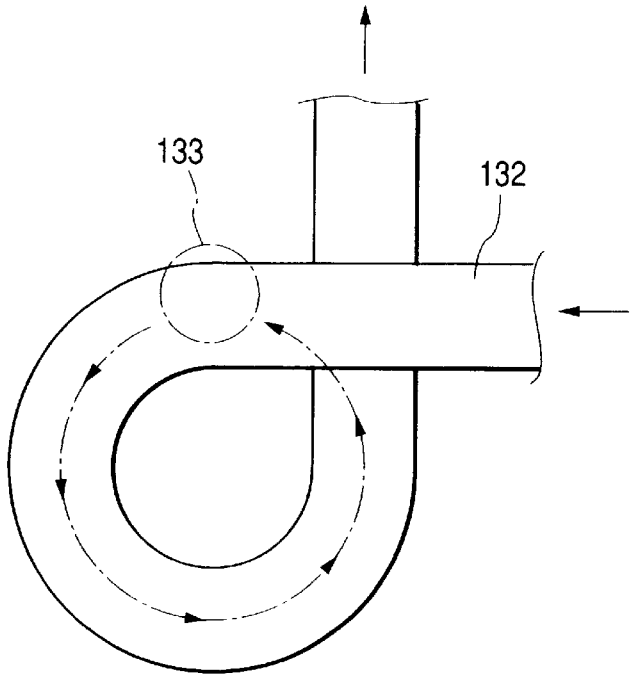
FIG. 23 is a side view useful in explaining the operation of the tube pump of FIG. 22.

Specifically, as indicated by an arrow (a chain line) in FIG. 23, when the rotary cylinder 134 rotates (the pump is in operation), a position where the ball body 133 presses the inner cylinder 135 continuously moves. With the movement, a pressing force of the ball body 133 is transmitted to the tube 132 via the swing cylinder 135, at a tube pressing position, and it is removed at a tube restoring position. Thus, the tube pressing operation and the tube restoring operation are concurrently performed.

The tube 132 being pressed flat gradually resumes its initial or original shape in the direction in which the tube pressing position moves by the ball body 133 (inner cylinder 135). Accordingly, a negative pressure applied to within the tube 132 (inner space of the cap member 10*b* of the capping unit 10) gradually increases, and ink is absorbed and discharged through the nozzle orifices 7*b* of the print head 7.

Accordingly, an elastic force of the tube 132 per se is not needed for the restoring of the tube in shape. Because of this, a design strictness in selecting the inside and outer diameters of the tube is lessened, and the pump design is simplified.

The feature that the elastic force of the tube per se is not needed for the restoring of the tube 132 in shape, implies that a material of the tube 132 may be selected from among an increased variety of materials. In this sense, a design freedom is increased in selecting the tube. Accordingly, a metal material, e.g., aluminum, may be used as a tube material.

Additionally, the fact that the tube 132 is able to resuming its initial state or shape through the swing motion of the inner cylinder 135 implies that there is no need of using a material having a large self-restoring ability for the tube material. Accordingly, the pressing load is reduced and the pump efficiency is increased.

Further, the restoration of the tube 132 to the initial state is performed through the swing motion of the inner cylinder 135. Therefore, there is no need of taking a measure for preventing a trouble caused by the tube clinging or the like, which inevitably occurs in the related technique. Also in this point, the pump design is simplified.

Figure 24:
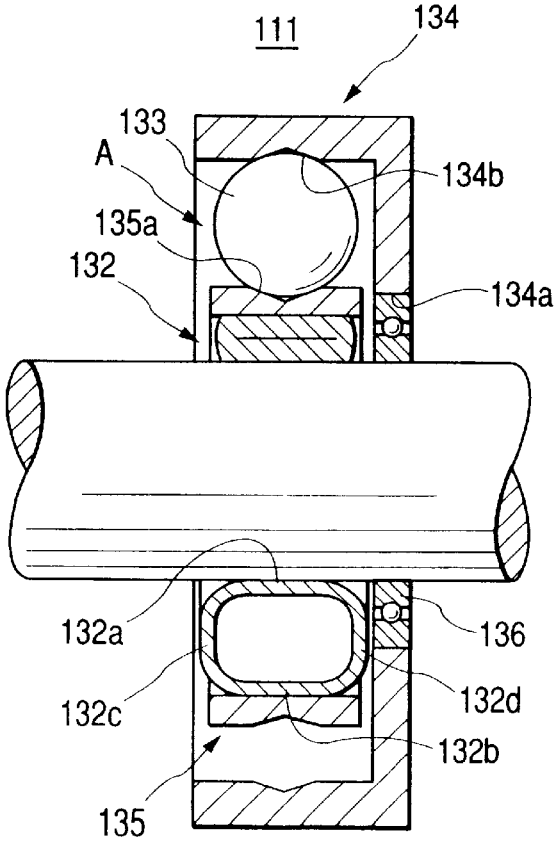
FIG. 24 is a cross sectional view a modification of the tube pump of FIG. 22.

In the embodiment, the ball body 133 is taken about by using a friction force generated between it and the outer tube body (rotary cylinder) 134, and is rolled on the outer surface of the tube body (swing cylinder) 135. The present invention is not limited to such an implementation, but may be implemented as shown in FIG. 24. In the figure, the ball body 133 is rotatably positioned on the rotary cylinder 134, and is roiled on the outer surface of the swing cylinder 135, while being guided.

In this case, a depression 134*b*, shaped like V in cross section, is formed on the swing cylinder 135. The depression positions the ball body 133 while allowing it to rotate idle. An annular ring groove 135*a*, shaped like V in cross section, is formed in the swing cylinder 135. The annular ring groove guides the ball body 133 in the circumference direction. Accordingly, when the rotary cylinder 134 is rotating (the pump is being driven), the ball body 133 rolls on the outer surface of the swing cylinder 135 and exactly along the annular ring groove 135*a*. As a result, a stable swinging operation of the swing cylinder 135 is secured.

Figure 25:
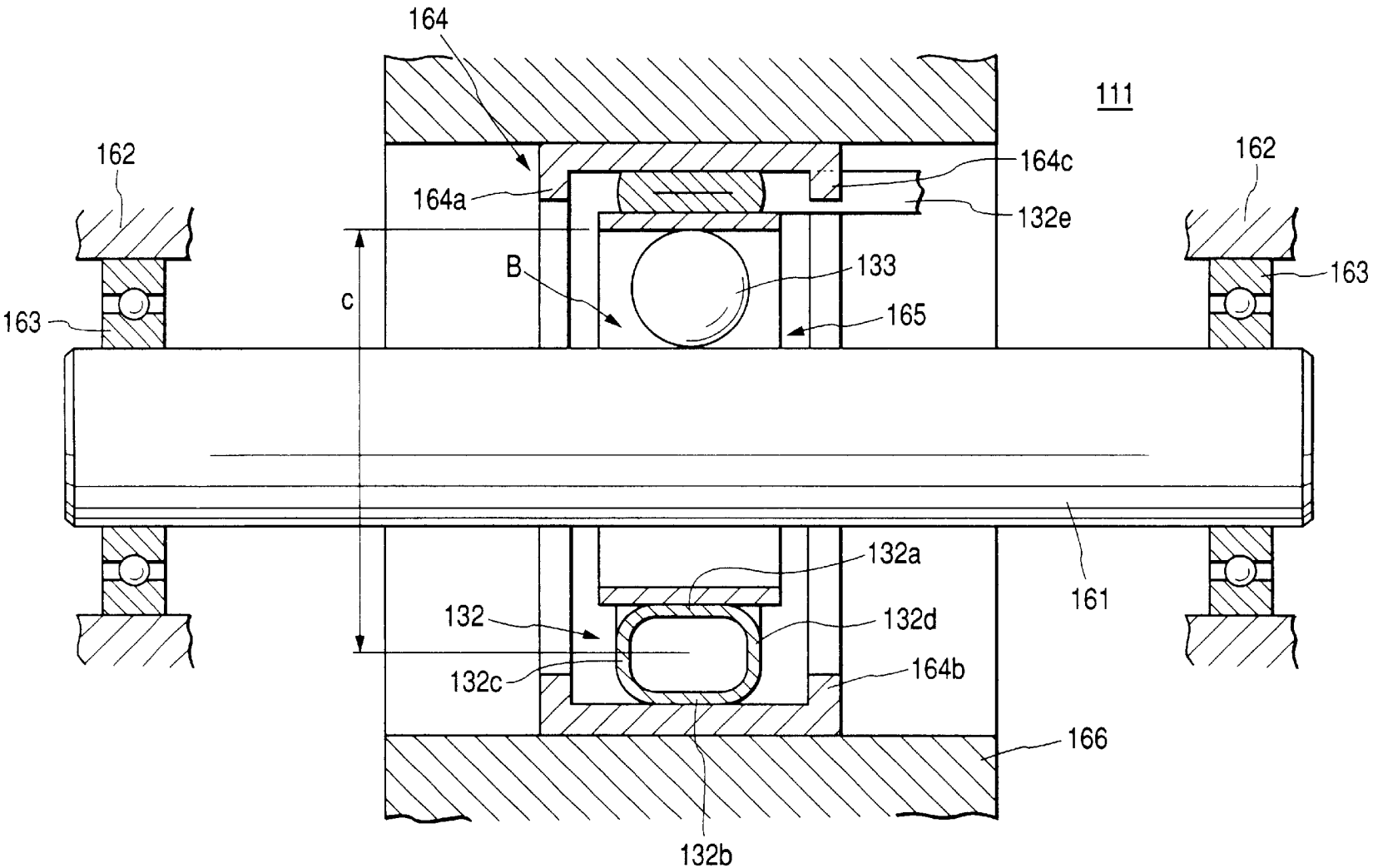
FIG. 25 is a cross sectional view showing an essential portion of a tube pump according to a twelfth embodiment of the invention.

FIG. 25 is a cross sectional view schematically showing an essential portion of a tube pump according to a twelfth embodiment of the modification. In the figure, a tube pump, a tube and a ball body are denoted by like reference numerals used in FIG. 22.

In the figure, a tube pump denoted by reference numeral 111 includes a pump shaft (center of rotation) 161 which is rotated by a drive unit (not shown). The pump shaft 161 is rotatably mounted on a fixed wall 162 with a ball bearing 163 being interposed therebetween. The tube 132 is disposed surrounding the pump shaft 161. The tube 132 is able to deform in the radial direction of the tube itself and restore its shape to its original shape. With such a structure, when the pump shaft 161 is rotated in a state that the pump is being driven, a friction force develops between the outer surface of the pump shaft 161 and the ball body 133. The ball body 133 rolls on the inner surface of a swing cylinder (to be described later), while being drawn in the rotational direction of the pump shaft 161.

The tube 132 is interposed between the inner surface of a fixed cylinder to be described later and the outer surface of a short tube to also be described later. To be more specific, the inner and outer walls 132*a* and 132*b* of the tube 132 are fastened to the outer surface of a swing cylinder (to be described later) and the inner surface of the fixed cylinder (to be also described later) by an appropriate manner, such as adhesive, welding or fastening.

An rolling path B, while extending in the circumferential direction of the pump shaft 131, is disposed around the winding central axis (axial line of the pump shaft) of the tube 132. A ball body 133 is located within the rolling path B and rollable in the circumference direction of the pump shaft 131. Two cylinders 164 and 165, inner and outer cylinders, having different diameters are disposed on the outer side of the rolling path B for the ball body 133.

The inner diameter of the rolling path B is selected to be equal to the outer diameter of the pump shaft 161. The outer diameter "c" of it (rolling path) is equal to the sum of twice the outer diameter of the ball body 133 and the outer diameter of the pump shaft 161. The width of the rolling path B is substantially equal to the outer diameter of the ball body 133.

Of the cylinders 164 and 165, the outer cylinder 164 is a fixed cylinder (with no bottom) being opened at both ends. It is disposed on the center line of the tube winding, and is mounted on a fixing wall (tube wall) 166, which located around the pump shaft 161. Inner flanges 164*a* and 164*b* are provided at both the opened ends of the cylinder 164. The end faces of each of those flanges are opposed to each other with the tube 132 being located therebetween. Of those inner flanges 164*a* and 164*b*, the inner flange 164*a* has a cutout 164*c* formed therein through which take-out portion 132*e* of the tube 132 is taken out in the axial direction of the pump shaft 161.

The inner cylinder 165 is a swing cylinder (with no bottom) which is swung by the rolling of the ball body 133 caused by the rotation of the pump shaft 161. It is held within the cylinder 164 in a state that it receives a pressing force of the ball body 133 and presses a part of the tube 132.

To smoothly roll the ball body 133 within the rolling path B when the pump is being driven (the pump shaft 161 is rotating), the inner cylinder 165 and the pump shaft 161 are preferably made of such a material as to develop a small friction force developing between the inner cylinder 165 and the ball body 133.

In the tube pump thus constructed, when the pump is driven, the pump shaft 161 is rotated. Then, the ball body 133, as shown in FIG. 25, rolls within the rolling path B in the circumference direction of the pump shaft 161 while pressing the inner surface of the swing cylinder 165. With the rolling, the swing cylinder 165 swings in a plane perpendicular to the pump shaft 131.

In this case, when the ball body 133 presses the outer surface of the swing cylinder 165, the swing cylinder 165 moves in the radial direction of the pump shaft 161. The tube 132 is pressed (closed) in the tube winding radial direction at a position (upper side in FIG. 25) at which the inner surface of the swing cylinder 165 is closest to the inner surface of the fixed cylinder 164. At a position (lower side in FIG. 25) where it is furthest from the inner surface of the fixed cylinder 164, the tube 132 is restored to its initial state or shape (it resumes its initial shape).

Specifically, as indicated by an arrow (a chain line) in FIG. 23, when the rotary cylinder 134 rotates (the pump is in operation), a position where the ball body 133 presses the swing cylinder 165 continuously moves. With the movement, a pressing force of the ball body 133 is transmitted to the tube 132 via the swing cylinder 165, at a tube pressing position, and it is removed at a tube restoring position. Thus, the tube pressing operation and the tube restoring operation are concurrently performed.

The tube 132 being pressed flat gradually resumes its initial or original shape in the direction in which the tube pressing position moves by the ball body 133 (inner cylinder 135). Accordingly, a negative pressure applied to within the tube 132 (inner space of the cap member 10*b* of the capping unit 10) gradually increases, and ink is absorbed and discharged through the nozzle orifices 7*b* of the print head 7.

Accordingly, an elastic force of the tube per se is not needed for the restoring of the tube 132 in shape. Because of this, the pump design is simplified, and a design freedom is increased in selecting the tube.

Additionally, the fact that the tube 132 is able to resuming its initial state or shape through the swing motion of the inner cylinder 165 indicates that there is no need of using a material having a large self-restoring ability for the tube material. Accordingly, the pump efficiency is increased.

Further, the restoration of the tube 132 to the initial state is performed through the swing motion of the swing cylinder 165. Therefore, there is no need of taking a measure for preventing a trouble caused by the tube clinging or the like, which inevitably occurs in the related technique. Also in this point, the pump design is simplified.

Figure 26:
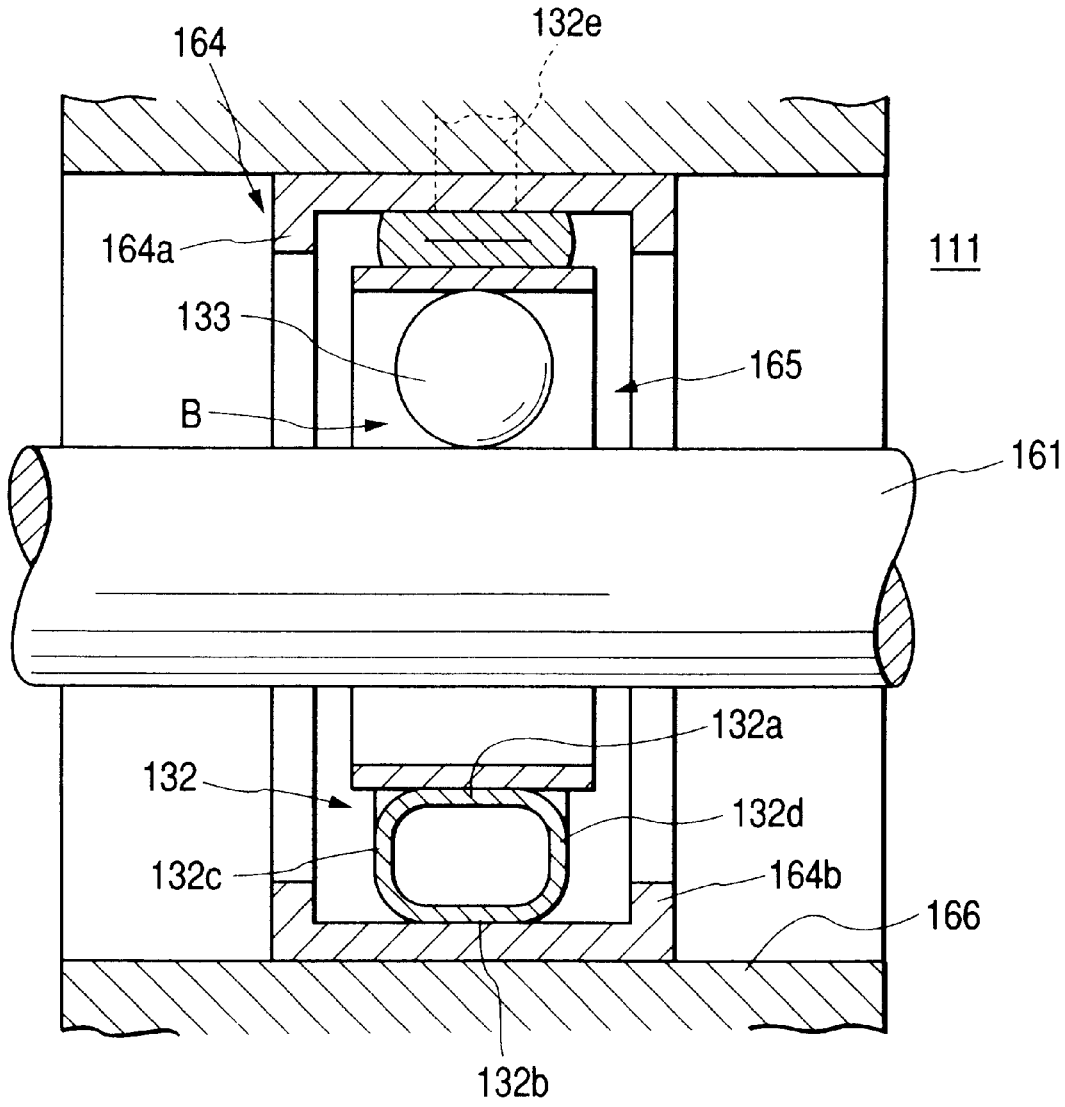
FIG. 26 is a cross sectional view showing a modification of the tube pump of FIG. 25.

While in the above embodiments, the take-out portion 132*e* of the tube 132 is taken out in the axial direction of the pump shaft 131, it may be taken out in the radial direction of the pump shaft 161, as shown in FIG. 26, if required. By so doing, at the time of assembling the pump, the take-out portion 132*e* of the tube 132 is inserted into the fixed cylinder 164 and the fixed wall 166.

Figure 27:
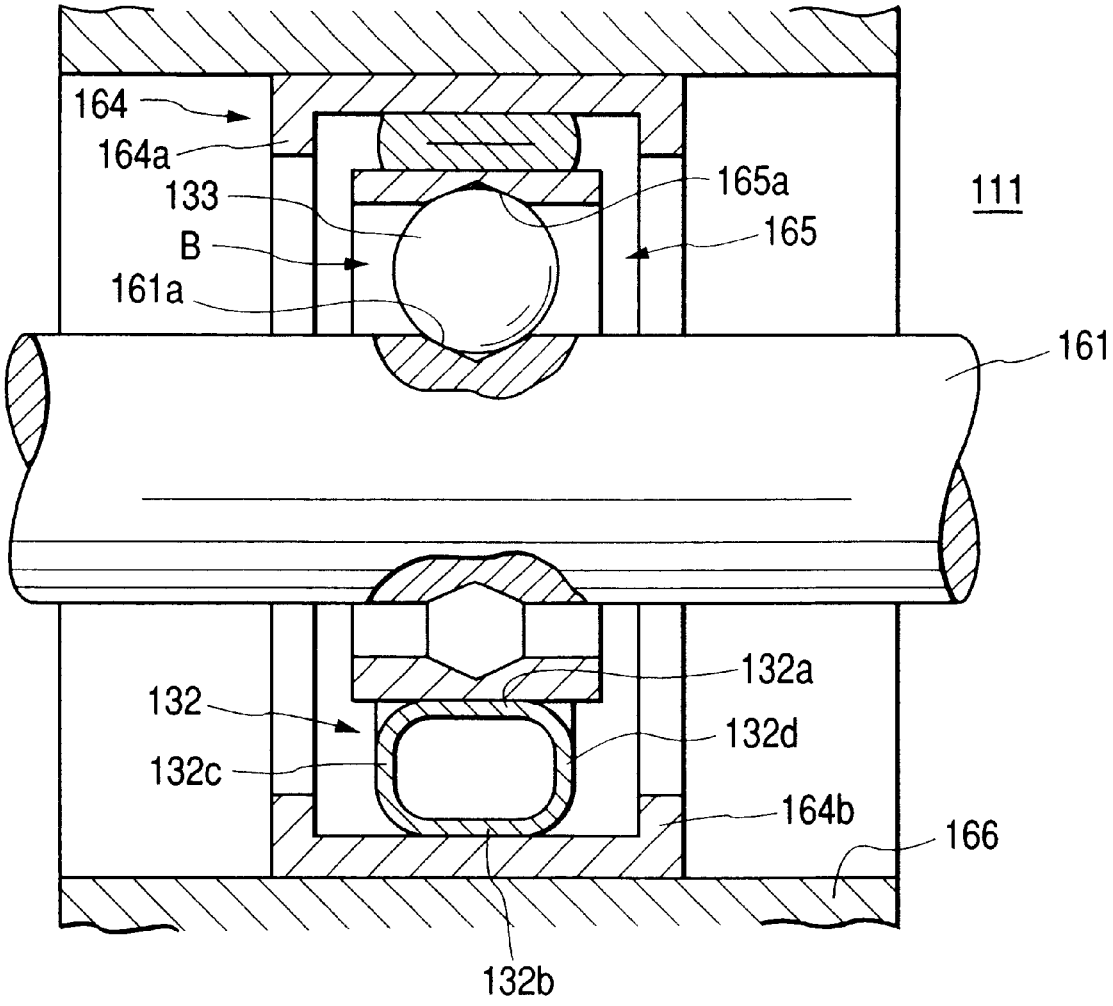
FIG. 27 is a cross sectional view showing another modification of the tube pump of FIG. 25.

In the modification, the ball body 133 is taken about by using a friction force generated between it and pump shaft 161, and is rolled on the outer surface of the tube (swing cylinder) 165. The present invention is not limited to such an implementation, but may be implemented as shown in FIG. 27. In the figure, the ball body 133 is rotatably positioned on the pump shaft 161, and is rolled on the outer surface of the swing cylinder 165, while being guided.

In this case, a depression 161*a*, shaped like V in cross section, is formed on the pump shaft 161. The depression positions the ball body 133 while allowing it to rotate idle. An annular ring groove 165*a*, shaped like V in cross section, is formed in the swing cylinder 165. The depression guides the ball body 133 in the circumference direction. Accordingly, when the pump shaft 161 is rotating (the pump is being driven), the ball body 133 rolls on the outer surface of the swing cylinder 165 and exactly along the annular ring groove 165*a*. As a result, a stable swinging motion of the swing cylinder 165 is secured.

Figure 28:
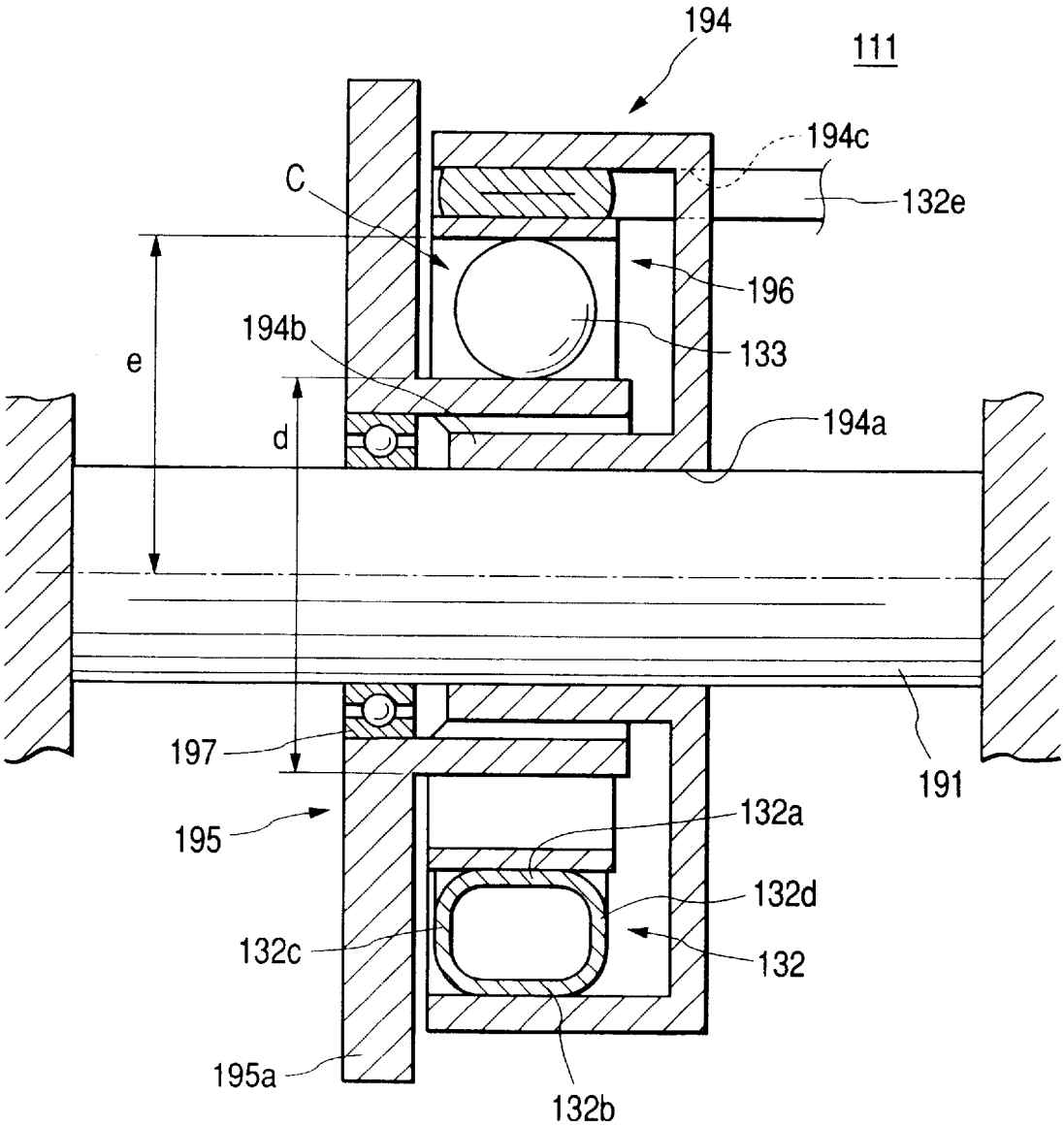
FIG. 28 is a cross sectional view showing an essential portion of a tube pump according to a thirteenth embodiment of the invention.

FIG. 28 is a cross sectional view schematically showing an essential portion of a tube pump according to a thirteenth embodiment of the invention. In the figure, a tube pump, a tube and a ball body are denoted by like reference numerals used in FIGS. 22 and 25.

In the figure, a tube pump 111 includes a pump shaft 191 as a fixed center axis. A tube 132 is disposed surrounding the pump shaft 191 in a ring-like fashion. The tube 132 is able to deform in the radial direction of the tube and restores its shape to its original one.

The tube 132 is interposed between the inner surface of a fixed cylinder to be described later and the outer surface of a swing cylinder to be also described later. To be more specific, the inner and outer walls 132*a* and 132*b* of the tube 132 are fastened to the inner surface of the fixed cylinder (to be described later) and the outer surface of a swing cylinder (to be also described later) by an appropriate manner, such as adhesive, welding or fastening.

An rolling path C, while extending in the circumferential direction of the pump shaft 191, is disposed around the winding central axis (axial line of the pump shaft) of the tube 132. A ball body 133 is located within the rolling path C and rollable in the circumference direction of the pump shaft 191. Three cylinders 194 to 196, inner and outer cylinders, having different diameters are disposed on the outer and inner sides of the rolling path C for the ball body 133.

The inner diameter "d" of the rolling path C is selected to be equal to the outer diameter of a rotary cylinder (to be described later). The outer diameter of the rolling path C is 2*e* (where "e" is the shortest distance from a tube pressing position by the ball body 133 to the axial line of the pump shaft 191). The width of the rolling path C is substantially equal to the outer diameter of the ball body 133.

Of the cylinders 194 to 196, the outermost cylinder 194 is a fixed cylinder (with the bottom) being opened in the axial direction (one direction). It is mounted on the outer surface of the pump shaft 191. A shaft insertion hole 194*a* through which the pump shaft 191 passes, and a cylinder 194*b* are provided in the bottom of the cylinder 194. The cylinder 194*b* stands upright at the edge of the opening of the shaft insertion hole 194*a*. A through hole 194*c* is provided in the cylinder 194. Through hole 194*c*, a take-out portion 132*e* of the tube 132 is taken out in the axial direction of the pump shaft 191.

The innermost cylinder 195 consists of a rotary cylinder (with no bottom), which is rotatable about the axial line (tube winding center axis) of the cylinder 194. It is rotatably mounted on the outer surface of the pump shaft 191. With this structure, when the innermost cylinder 195 is rotated when the pump is driven, a friction force develops between the outer surface of the innermost cylinder 195 and the ball body 133. The ball body 133 rolls on and along the inner surface of the cylinder 196, while being drawn in the rotational direction of the cylinder 195. A flange 195*a* is integrally formed on the outer surface of the innermost cylinder 195. The flange has a flange end face, which is opposed to the bottom of the cylinder 194 with the ball body 133 located therebetween.

The cylinder 196, which is located between the cylinders 194 and 195, consists of a swing cylinder (with no bottom) which is swung by the rolling of the ball body 133, caused by the rotation of the innermost cylinder 195. It is held in a state that the cylinder 194 receives a pressing force of the ball body 133 and it presses a part of the tube 132.

In order that with rotation of the cylinder 195 when the pump is operating (the cylinder 195 is rotating), the ball body 133 smoothly rolls within the rolling path C, the cylinders 195 and 196 are made of such a material as to develop a small friction force between the cylinders 195 and 196.

In the tube pump thus constructed, when the innermost tube body (rotary cylinder) 195 is rotated about the pump shaft 191, then the ball body 133, as shown in FIG. 28, rolls within the rolling path C in the circumference direction of the pump shaft 191 while pressing the inner surface of the swing cylinder 196. With the rolling, the cylinder 196 swings in a plane perpendicular to the pump shaft 191.

In this case, when the ball body 133 presses the inner surface of the swing cylinder 196, the swing cylinder 196 moves in the radial direction of the pump shaft 191. The tube 132 is pressed (closed) in the tube winding radial direction at a position (upper side in FIG. 28) at which the outer surface of the swing cylinder 196 is closest to the inner surface of the fixed cylinder 194. At a position (lower side in FIG. 28) where it is furthest from the inner surface of the fixed cylinder 194, the tube 132 is restored to its initial state or shape (it resumes its initial shape).

Specifically, as indicated by an arrow (a chain line) in FIG. 23, when the rotary cylinder 195 rotates (the pump is in operation), a position where the ball body 133 presses the swing cylinder 196 continuously moves. With the movement, a pressing force of the ball body 133 is transmitted to the tube 132 via the swing cylinder 196, at a tube pressing position, and it is removed at a tube restoring position. Thus, the tube pressing operation and the tube restoring operation are concurrently performed.

The tube 132 being pressed flat gradually resumes its initial or original shape in the direction in which the tube pressing position moves by the ball body 133 (swing cylinder 196). Accordingly, a negative pressure applied to within the tube 132 (inner space of the cap member 10*b* of the capping unit 10) gradually increases, and ink is absorbed and discharged through the nozzle orifices 7*b* of the print head 7.

Accordingly, an elastic force of the tube per se is not needed for the restoring of the tube 132 in shape. Because of this, the pump design is simplified, and a design freedom is increased in selecting the tube.

Additionally, the fact that the tube 132 is able to resuming its initial state or shape through the swing motion of the swing cylinder 196 indicates that there is no need of using a material having a large self-restoring ability for the tube material. Accordingly, the pump efficiency is increased.

Further, the restoration of the tube 132 to the initial state is performed through the swing motion of the swing cylinder 196. Therefore, there is no need of taking a measure for preventing a trouble caused by the tube clinging or the like, which inevitably occurs in the related technique. Also in this point, the pump design is simplified.

Figure 29:
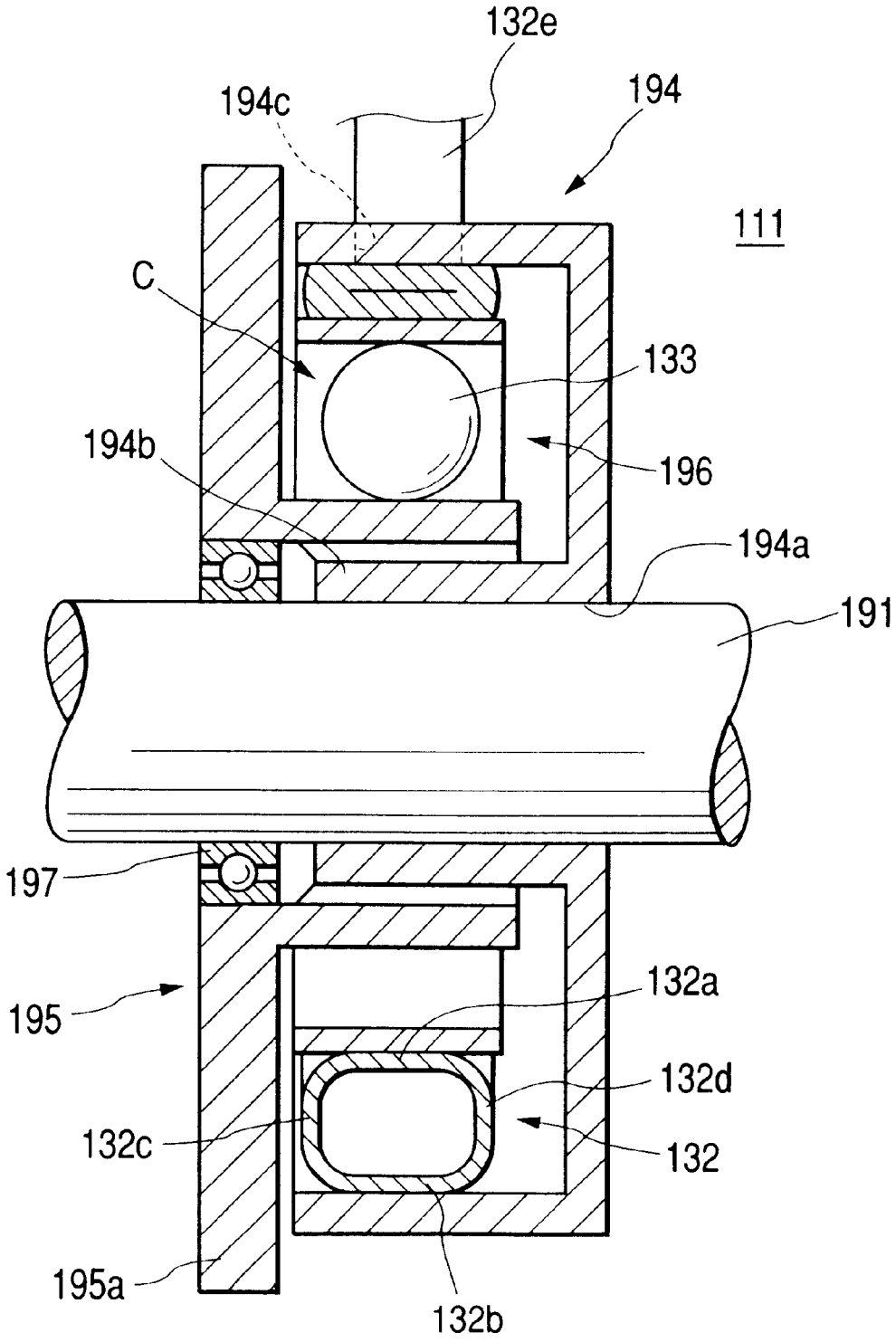
FIG. 29 is a cross sectional view showing a modification of the tube pump of FIG. 28.

While description has been made about a case where the take-out portion 132*e* of the wiper 12 is taken out in the axial direction, the present invention may be implemented as shown in FIG. 29. In the figure, it may be taken out in the radial direction of the pump shaft 191. In this case, a through hole 194*c* is formed in the circumferential wall of the pump shaft 191. Through the through hole 194*c*, the take-out portion 132*e* of the tube 132 is taken out in the radial direction of the pump shaft 191. By so doing, at the time of assembling the pump, the take-out portion 132*e* of the tube 132 is inserted into the cylinder 194 (through hole 194*c*).

Figure 30:
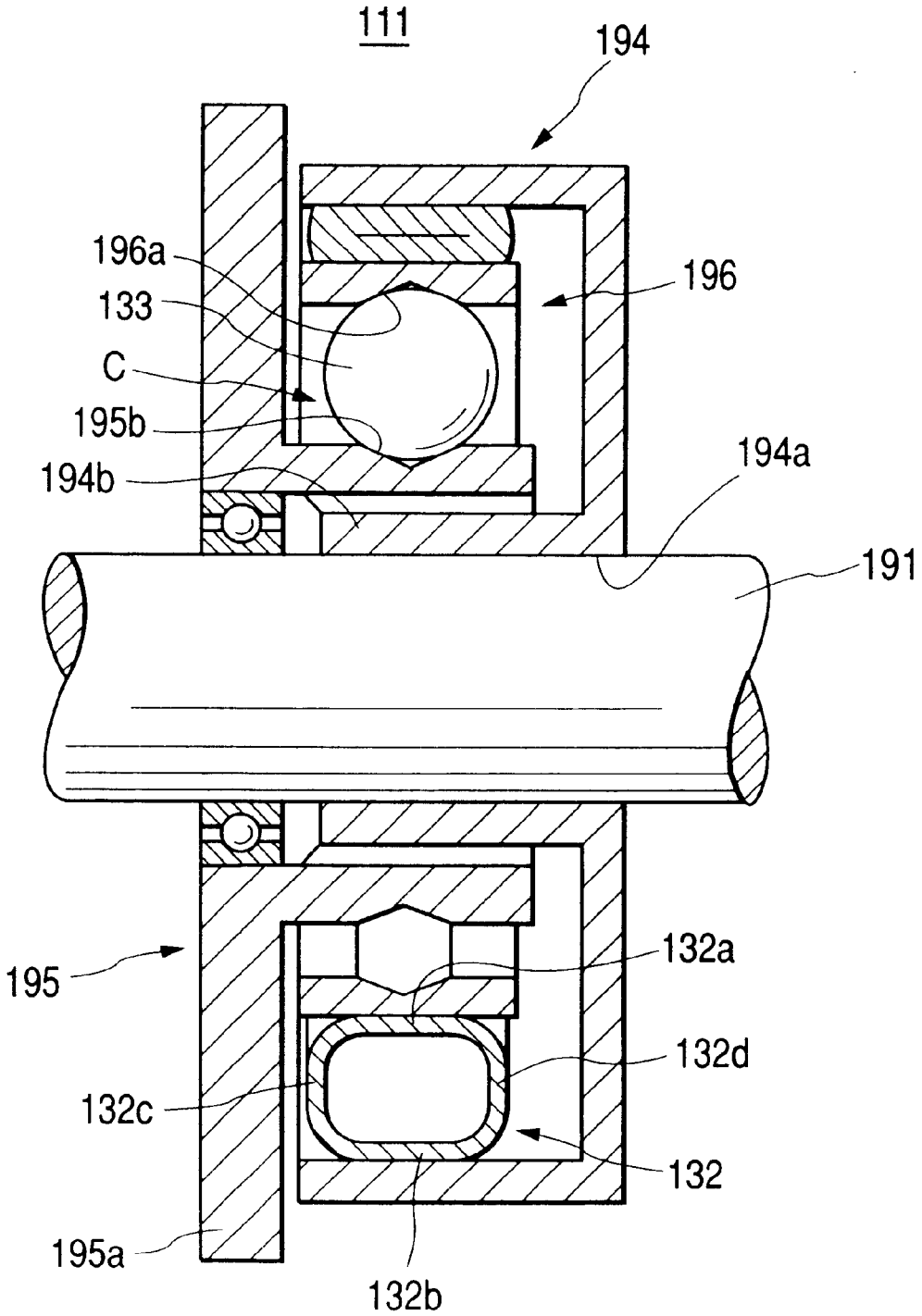
FIG. 30 is a cross sectional view showing another modification of the tube pump of FIG. 28.
Figure 31:
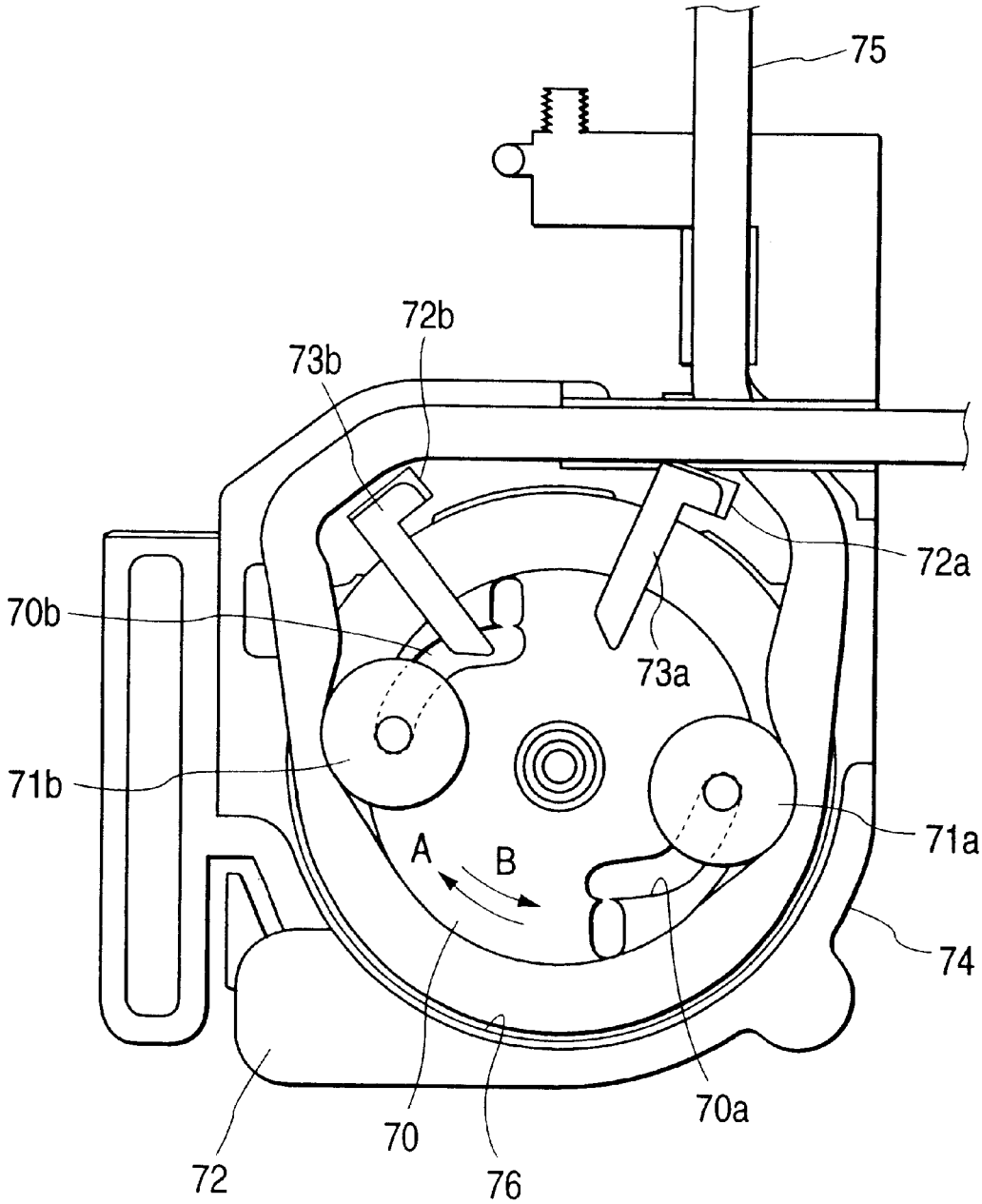
FIG. 31 is a view showing a related tube pump.

While description has been made about a case the ball body 133 is taken about by using a friction force generated between the ball body 133 and rotary cylinder 195, and is rolled on the inner surface of the swing cylinder 196. The present invention is not limited to such an implementation, but may be implemented as shown in FIG. 30. In the figure, the ball body 133 is rotatably positioned on the rotary cylinder 195, and is rolled on the inner surface of the swing cylinder 196, while being guided.

In this case, a depression 195*b*, shaped like V in cross section, is formed on the cylinder 195. The depression positions the ball body 133 while allowing it to rotate idle. An annular ring 196*a*, shaped like V in cross section, is formed in the swing cylinder 196. The depression guides the ball body 133 in the circumference direction. Accordingly, when the rotary cylinder 195 is rotating (the pump is being driven), the ball body 133 rolls on the inner surface of the swing cylinder 196 and exactly along the annular ring 196*a*. As a result, a stable swinging operation of the swing cylinder 196 is secured.

While in the embodiments mentioned above, the present invention is applied to the ink jet recording apparatus which uses a tube pump for restoring the ink-ejection capability, the invention may be applied to other types of ink jet recording apparatus. An example of such is an ink jet recording apparatus in which the tube pump is used for an ink supplier for supplying ink from a main tank to a sub-tank.

In the embodiments mentioned above, the tube pressing operation by pressing a part of the tube and the tube restoring operation are concurrently performed. The invention may be applied to a case where both the operations are not concurrently performed. In this case, the tube is not constantly pressed. Therefore, it is necessary to prevent a backward flow of ink in the ink passage.

In a case that the tube pump is used for restoring the ink-ejection capability, a check valve (not shown) is provided between the tube pump and the capping unit or between tube pump and a waste ink tank. In a case that the tube pump is used for the ink supplier, a check valve (not shown) is provided between the main tank and the tube pump or between the tube pump and the sub-tank.

While in each embodiment mentioned above, the ink jet recording apparatus uses a single tube pump, it should be understood that the invention may be applied to an ink jet recording apparatus using a plurality of tube pumps.

What is claimed is:

1. A tube pump, comprising:

a drive shaft;

a rotor, fixed to the drive shaft so as to rotate therewith;

a tube pressing member, being swingable in an axial direction of the drive shaft;

a swinging member for swinging the tube pressing member in accordance with the rotation of the rotor;

a tube, an upper outer face of which is fixed to a lower portion of the tube pressing member;

a fixing member, to which a lower outer face of the tube is fixed, wherein the tube is forcibly pressed and expanded in accordance with the swing motion of the tube pressing member, while a pressed/expanded part of the tube is shifted in an extending direction of the tube.

2. The tube pump as set forth in claim 1, wherein the tube pressing member is provided as a plate member which is opposed to the rotor.

3. The tube pump as set forth in claim 1, further comprising a spring member, for urging the fixing member toward the tube pressing member.

4. The tube pump as set forth in claim 3, further comprising:

a flange, formed at a lower end portion of the drive shaft, to which a lower end of the spring member is fixed;

a plate member, to which an upper end of the spring member is fixed; and a ball bearing, provided between a lower face of the fixing member and an upper face of the plate member.

5. The tube pump as set forth in claim 2, wherein the rotor is provided as a rotary disk member.

6. The tube pump as set forth in claim 1, wherein the rotor is provided as a rotary conical member.

7. The tube pump as set forth in claim 1, wherein the rotor is provided as a bar member, one end of which is fixed to the drive shaft.

8. The tube pump as set forth in claim 5, wherein the swinging member is provided as a ball body interposed between the rotary disk member and the tube pressing plate, so as to be movably fitted with a groove formed on an upper face of the tube pressing plate.

9. The tube pump as set forth in claim 8, wherein the groove is situated closer to the drive shaft than a cross sectional center of the tube.

10. The tube pump as set forth in claim 5, wherein the swinging member includes:

a spring member, one end of which is fixed to the rotary disk member;

a ball body, being movable on an upper face of the tube pressing plate; and a holder, to which the other end of the spring member is fixed, the holder for holding the ball body.

11. The tube pump as set forth in claim 6, wherein the swinging member is provided as a frustum body held by a side face of the rotary conical member, such that an axis of the frustum body is in parallel with a generatrix of the conical member.

12. The tube pump as set forth in claim 7, wherein the swinging member is provided as a columnar body held by the bar member so as to be rotatable about an axis of the bar member.

13. The tube pump as set forth in claim 2, wherein a through hole is formed at a center portion of the tube pressing plate, through which the drive shaft is inserted;

wherein the diameter of the through hole is larger than the diameter of the drive shaft; and wherein a cylindrical member is formed on a lower face of the tube pressing plate so as to surround the through hole.

14. The tube pump as set forth in claim 2, wherein the tube pressing plate is shaped into a hollowed cone so as to be swingable about a vertex of the cone.

15. The tube pump as set forth in claim 1, further comprising a ball bearing interposed between the drive shaft and the tube pressing member.

16. The tube pump as set forth in claim 1, wherein the tube is fixed to the tube pressing member and the fixing member by either adhesive or welding.

17. The tube pump as set forth in claim 1, wherein the tube pressing member, the tube and the fixing member are integrally formed.

18. The tube pump as set forth in claim 1, wherein the tube and the fixing member are integrally formed; and wherein a hook member is formed on the upper outer face of the tube, which is engaged with an engagement member formed on the lower portion of the tube pressing member.

19. The tube pump as set forth in claim 1, wherein the tube includes an upper tube part and a lower tube part, which are connected to form a tube;

wherein an upper face of the upper tube part and the tube pressing member are integrally formed; and wherein a lower face of the lower tube part and the fixing member is integrally formed.

20. The tube pump as set forth in claim 1, wherein the tube pressing member is provided with a hole for holding a projection formed on the upper outer face of the tube; and wherein the fixing member is provided with a hole for holding a projection formed on the lower outer face of the tube.

21. The tube pump as set forth in claim 1, wherein the tube is made of a material having a relatively low self-restoring ability.

22. The tube pump as set forth in claim 1, wherein the tube is made of a material having a relatively low stiffness.

23. The tube pump as set forth in claim 1, wherein the tube pressing member always presses at least a part of the tube.

24. A tube pump, comprising:

a pump shaft, provided as a fixed central shaft;

a tube, wound around the pump shaft, the tube being deformable in a radial direction of the pump shaft;

an inner cylindrical member, for surrounding the tube therein;

an outer cylindrical member, being rotatable around the pump shaft, while defining an annular passage between the inner cylindrical member; and a ball body, provided in the annular passage while being movable therein in accordance with the rotation of the outer cylindrical member, wherein the inner cylindrical member is eccentrically swung by the movement of the ball body, while deforming the tube.

25. The pump tube as set forth in claim 24, wherein grooves are formed on an inner face of the outer cylindrical member and an outer face of the inner cylindrical member, for guiding the movement of the ball body.

26. The pump tube as set forth in claim 24, wherein grooves are formed on an inner face of the inner cylindrical member and an outer face of the pump shaft, for guiding the movement of the ball body.

27. The pump tube as set forth in claim 24, wherein an inner peripheral portion of the tube is integrated with an outer face of the pump shaft; and wherein an outer peripheral portion of the tube is integrated with an inner face of the inner cylindrical member.

28. A tube pump, comprising:

a pump shaft, provided as a rotary central shaft;

an inner cylindrical member, for defining an annular passage between the pump shaft;

a tube, wound around the inner cylindrical member, the tube being deformable in a radial direction of the pump shaft;

an outer cylindrical member, being fixed with respect to the pump shaft, while surrounding the tube therein; and a ball body, provided in the annular passage while being movable therein in accordance with the rotation of the pump shaft, wherein the inner cylindrical member is eccentrically swung by the movement of the ball body, while deforming the tube.

29. The pump tube as set forth in claim 28, wherein an inner peripheral portion of the tube is integrated with an outer face of the inner cylindrical member; and wherein an outer peripheral portion of the tube is integrated with an inner face of the outer cylindrical member.

30. A tube pump, comprising:

a pump shaft, provided as a fixed central shaft;

a first cylindrical member, being rotatable around the pump shaft;

a second cylindrical member, for defining an annular passage between the first cylindrical member;

a tube, wound around the second cylindrical member, the tube being deformable in a radial direction of the pump shaft;

a third cylindrical member, being fixed with respect to the pump shaft while surrounding the tube therein; and a ball body, provided in the annular passage while being movable therein in accordance with the rotation of the first cylindrical member, wherein the second cylindrical member is eccentrically swung by the movement of the ball body, while deforming the tube.

31. The pump tube as set forth in claim 30, wherein grooves are formed on an inner face of the second cylindrical member and an outer face of the first cylindrical member, for guiding the movement of the ball body.

32. The pump tube as set forth in any one of claims 24, 28 and 30, wherein the tube is taken out in an axial direction of the pump shaft.

33. The pump tube as set forth in any one of claims 24, 28 and 30, wherein the tube is taken out in the radial direction of the pump shaft.

34. The pump tube as set forth in any one of claims 24, 28 and 30, wherein the ball body always presses at least a part of the tube.

35. The pump tube as set forth in any one of claims 24, 28 and 30, wherein the tube is made of a material having a relatively low self-restoring ability.

36. The pump tube as set forth in any one of claims 24, 28 and 30, wherein the tube is made of a metal having a stiffness which is deformable by the ball body.

37. The pump tube as set forth in any one of claims 24, 28 and 30, wherein a friction resistance of an inner surface of the tube is larger than a friction resistance of an outer surface of the tube.

38. The pump tube as set forth in claim 30, wherein an inner peripheral portion of the tube is integrated with an outer face of the second cylindrical member; and wherein an outer peripheral portion of the tube is integrated with an inner face of the third cylindrical member.

39. The pump tube as set forth in any one of claims 24, 28 and 30, wherein the tube is interposed through use of either adhesive or welding.

* * * * *